US012404672B2

(12) United States Patent
Yin

(10) Patent No.: US 12,404,672 B2
(45) Date of Patent: Sep. 2, 2025

(54) TIE BAR FOR SHEAR WALL, SHEAR WALL, AND METHOD FOR CONSTRUCTING THE SAME

(71) Applicant: RUENTEX ENGINEERING & CONSTRUCTION CO., LTD., Taipei (TW)

(72) Inventor: Samuel Yin, Taipei (TW)

(73) Assignee: RUENTEX ENGINEERING & CONSTRUCTION CO., LTD, Taipei (TW)

( * ) Notice: Subject to any disclaimer, the term of this patent is extended or adjusted under 35 U.S.C. 154(b) by 693 days.

(21) Appl. No.: 17/825,492

(22) Filed: May 26, 2022

(65) Prior Publication Data

US 2023/0111206 A1 Apr. 13, 2023

(30) Foreign Application Priority Data

Oct. 13, 2021 (TW) ..... 110137895

(51) Int. Cl.
*E04B 2/58* (2006.01)
*E04B 2/86* (2006.01)

(52) U.S. Cl.
CPC ..... *E04B 2/8635* (2013.01); *E04B 2/58* (2013.01)

(58) Field of Classification Search
CPC ..... E04C 5/0627; E04C 5/06; E04C 5/064; E04C 5/0622; E04C 5/0636; E04C 5/16; E04C 5/162; E04C 5/166; E04B 2/8635; E04B 2/58
See application file for complete search history.

(56) References Cited

U.S. PATENT DOCUMENTS

| | | | | | |
|---|---|---|---|---|---|
| 1,636,163 | A * | 7/1927 | Bitney | E04C 5/065 | 52/649.7 |
| 4,685,264 | A * | 8/1987 | Landis | E04G 11/46 | 249/28 |
| 5,317,846 | A * | 6/1994 | Michlovic | H02G 3/283 | 52/250 |
| 2002/0189175 | A1* | 12/2002 | Lancelot, III | E04C 5/16 | 52/378 |
| 2012/0177873 | A1* | 7/2012 | Gunther | E04C 5/168 | 428/114 |
| 2016/0108618 | A1* | 4/2016 | Buzimkic | E04C 2/06 | 52/649.1 |

FOREIGN PATENT DOCUMENTS

| | | | | |
|---|---|---|---|---|
| CA | 2867964 A1 | * | 2/2015 | E04B 5/32 |
| CN | 215670335 | * | 1/2022 | |
| CN | 215670335 U | * | 1/2022 | E04B 1/66 |
| KR | 20240020028 | * | 2/2024 | |

* cited by examiner

*Primary Examiner* — Jessica L Laux
(74) *Attorney, Agent, or Firm* — Juan Carlos A. Marquez; Marquez IP Law Office, PLLC

(57) ABSTRACT

A tie bar for fixing opposing steel meshes in a shear wall is provided. The shear wall includes a first steel mesh and a second steel mesh. The first steel mesh and the second steel mesh are spaced apart by a predetermined distance. The tie bar includes a first end portion, a second end portion, and two connections. The first end portion is configured to surround and be fixed to two adjacent vertical bars of the first steel mesh. The second end portion includes two free ends, and these two free ends are configured to respectively be fixed to two adjacent vertical bars of the second steel mesh. The two connections connect the first end portion and the second end portion respectively.

2 Claims, 23 Drawing Sheets

TIE BAR FOR SHEAR WALL, SHEAR WALL, AND METHOD FOR CONSTRUCTING THE SAME

BACKGROUND

1. Technical Field

The present disclosure relates to a tie bar for a shear wall, a shear wall including the tie bar, and a method for constructing the same.

2. Description of the Related Art

Conventional shear wall construction normally includes providing opposing steel meshes comprising intersecting vertical steel bars, spacing the two meshes by a distance, fixing and connecting the two meshes with conventional tie bars, enclosing the meshes with formworks, and filling spaces in the formworks with concrete.

Conventional tie bars generally consist of a straight steel bar having a hook at each of its respective ends. In a conventionally constructed shear wall, the hooks are fixed to the vertical bars of the two meshes at intervals of around four times the distance between the two meshes. Such arrangement requires use of a large number of tie bars for secure connection thereof, increasing labor and costs.

Therefore, it is desirable to provide a tie bar for a shear wall requiring fewer tie bars to be used.

SUMMARY

In one aspect, a tie bar for fixing opposing steel meshes in a shear wall is provided. The shear wall comprises a first steel mesh and a second steel mesh. The first steel mesh and the second steel mesh are spaced apart by a predetermined distance. The tie bar includes a first end portion, a second end portion and two connections. The first end portion is configured to surround and be fixed to two adjacent upstanding vertical bars of the first steel mesh. The second end portion has two free ends which are configured to respectively be fixed to two adjacent upstanding vertical bars of the second steel mesh. The two connections connect the first end portion and the second end portion respectively In another aspect, a construction method for a shear wall is provided. The method comprises providing two precast columns spaced apart by a predetermined distance, providing a plurality of tension bars in the two precast columns, wherein each of the plurality of tension bars has nut heads at two ends for connecting to bars, the nut heads being exposed, providing and connecting extending bars to the corresponding nut heads of the tension bars, providing a first steel mesh and a second steel mesh and disposing them between the two precast columns, wherein the first steel mesh and the second steel mesh are spaced apart by a predetermined distance, connecting the lateral ends of the first steel mesh and the second steel mesh to the extending bars, and providing a plurality of the tie bars and using the same to fix the first steel mesh and the second steel mesh. Each of the tie bars is configured to surround two adjacent upstanding vertical bars of the first steel mesh and two adjacent upstanding vertical bars of the second steel mesh.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

Aspects of some embodiments of the present disclosure are readily understood from the following detailed description when read with the accompanying figures. It should be noted that various structures may not be drawn to scale, and dimensions of the various structures may be arbitrarily increased or reduced for clarity of discussion.

DETAILED DESCRIPTION

Figure 1:
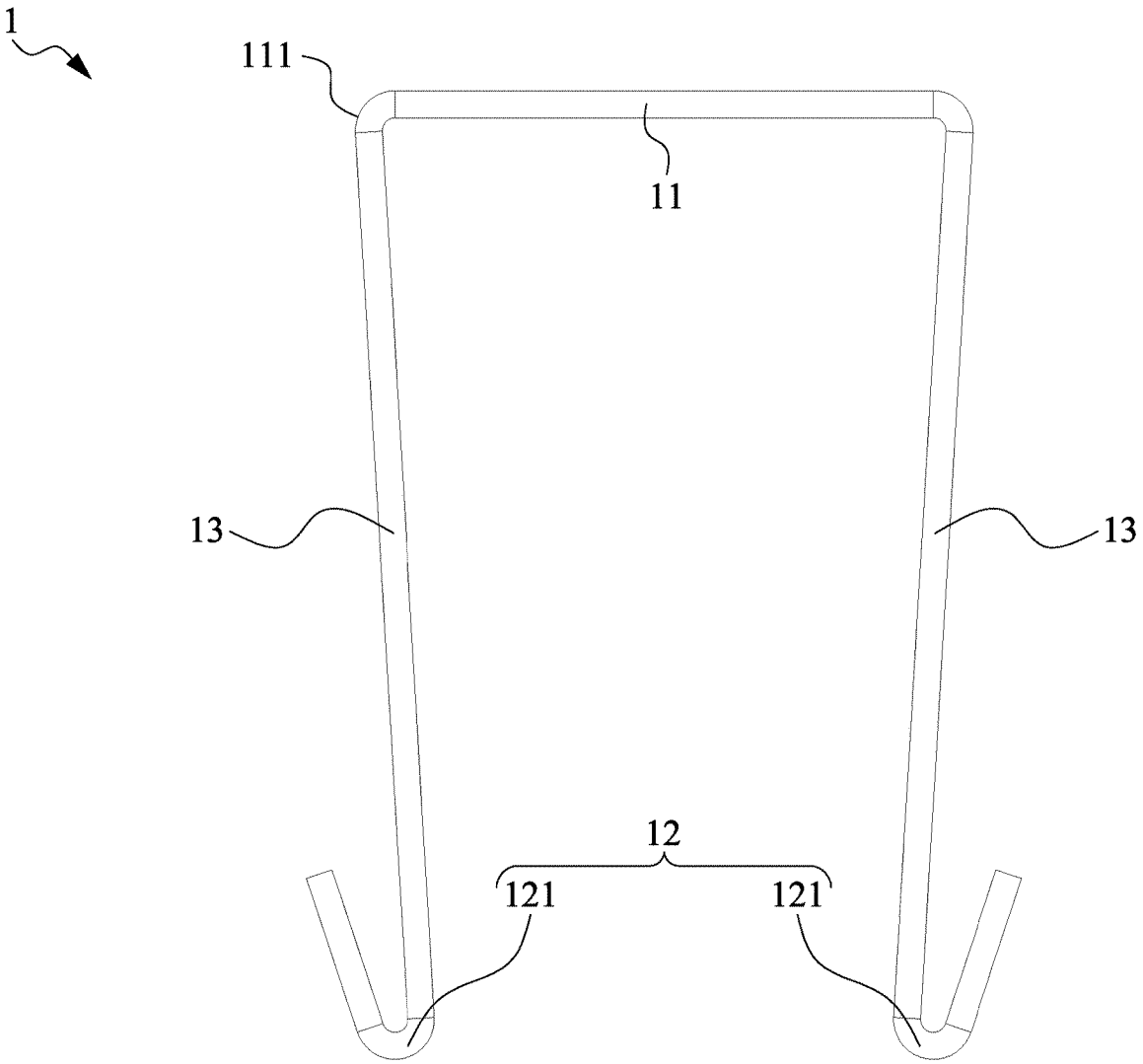
FIG. 1 is a schematic view of a tie bar for a shear wall in accordance with one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

It should be understood that, although the terms first, second, etc. may be used herein to describe various elements, these elements should not be limited by these terms. Unless indicated otherwise, these terms are only used to distinguish one element from another element.

As used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, two numerical values can be deemed to be "substantially" the same or equal if a difference between the values is less than or equal to ±10% of an average of the values, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

FIG. 1 is a schematic view of a tie bar 1 for a shear wall in accordance with one embodiment of the present disclosure. As shown in FIG. 1, the tie bar 1 of the present disclosure includes a first end portion 11, a second end portion 12, and two connections 13 connecting the first end portion 11 and the second end portion 12 respectively. The first end portion 11, the second portion 12 and the connections 13 are formed in one piece. The first end portion 11 is substantially inverted U-shaped and includes two bending sections 111 at its two sides. The second end portion 12 includes two free ends, each free end having a hook 121. In some embodiments of the present disclosure, a distance between the two bending sections 111 of the first end portion 11 is substantially equal to a distance between the two hooks 121 of the second end portion 12. In some embodiments of the present disclosure, one end of each of the connections 13 connects the bending section 111 of the first end portion 11 and the other end of each of the connections 13 connects the hook 121 of the second end portion 12. A distance between the two connections 13 gradually decreases along a direction from the first end portion 11 toward the second end portion 12. Further, the two hooks 121 of the second end portion 12 are opposite to each other and bent toward the outside of the tie bar 1.

FIGS. 2A-2K are a series of schematic views illustrating a construction method for manufacturing shear walls 100 and 100' by using the tie bar 1 according to an embodiment of the present disclosure.

Figure 2A:
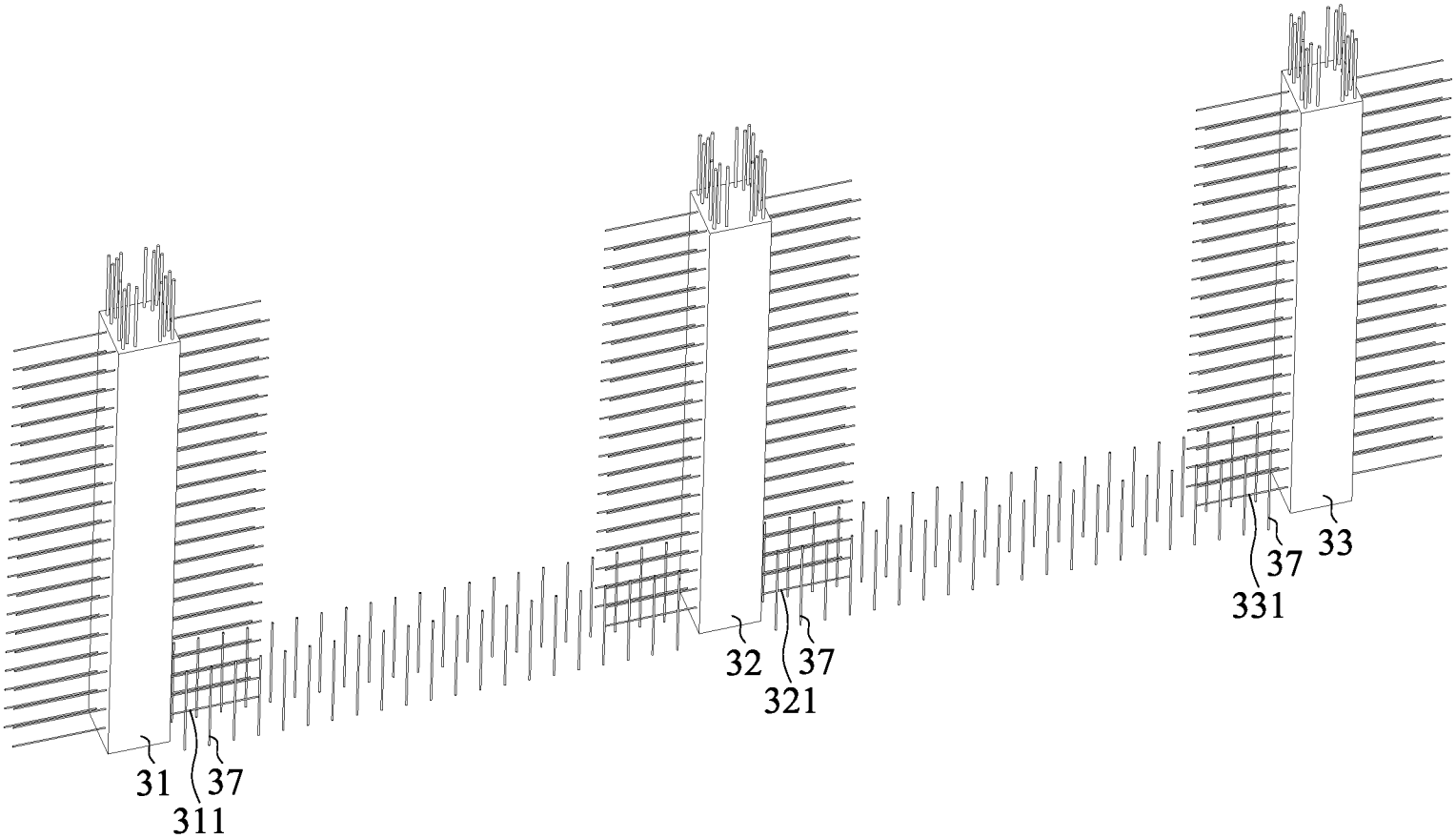
FIG. 2A is a first schematic view showing a construction method in accordance with an embodiment of the present disclosure.

As the embodiment shown in FIG. 2A, the construction method provides several precast columns 31, 32, 33 on a building site, the precast columns spaced apart by a predetermined distance. In some embodiments of the present disclosure, the distance between the precast columns 31 and the precast columns 32 is greater than, equal to, or less than a distance between the precast columns 32 and the precast columns 33. A plurality of vertical steel bars 37 are arranged on the building site and between the pillars 31, 32 and 33 for connecting and fixing the bottom sides of the steel mesh 10 and the steel mesh 20 (see FIGS. 2C and 2D).

Figure 2B:
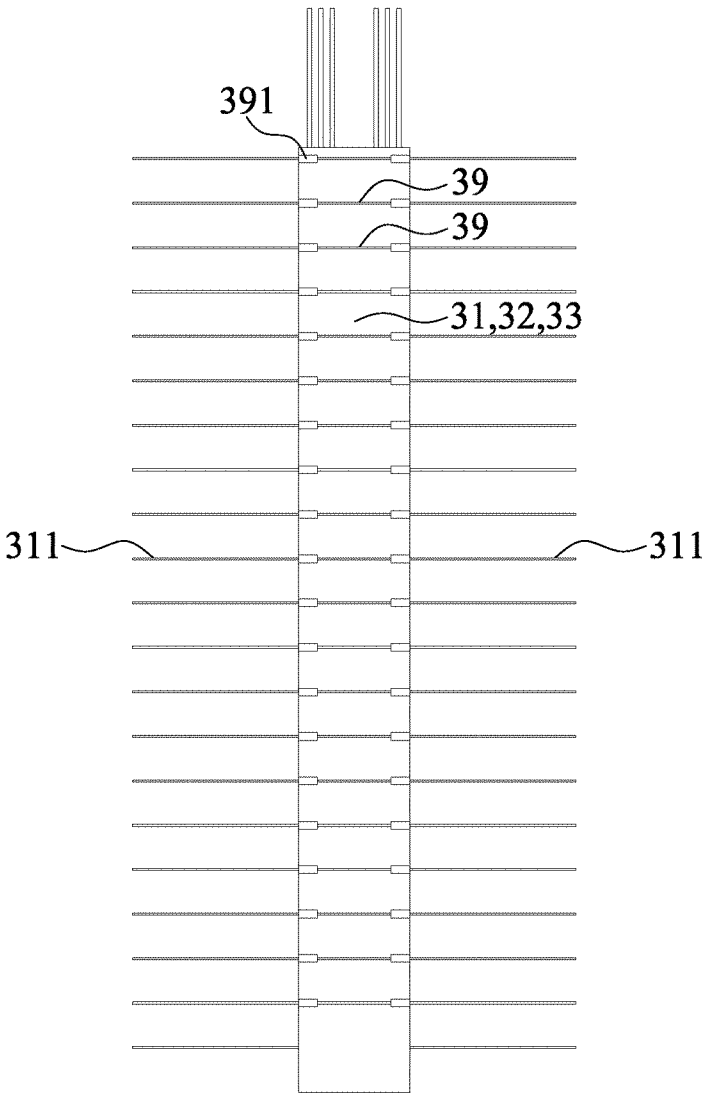
FIG. 2B is a second schematic view showing the structures of the precast columns in accordance with the embodiment of the present disclosure.

Please refer to FIG. 2B, which shows the structures of the precast columns 31, 32, 33. Each of the precast columns 31, 32, 33 is provided with a plurality of tension bars 39 along both the height and width of the precast columns 31, 32, 33. The end of each tension bar 39 is provided with nut heads 391, configured to connect steel bars. A plurality of extending bars 311 are respectively connected with the nut heads 391 of the corresponding tension bars 39. The extending bars 311 serve as extensions to be connected with the two sides of the steel mesh 10 and the steel mesh 20 (see FIGS. 2C and 2D). In some embodiments of the present disclosure, at least one of the extending bars 311 at two sides of the precast column 31 extends toward the precast column 32, and at least one of the extending bars 321 at two sides of the precast column 32 extends toward the precast column 31, and at least one of the extending bars 321 at two sides of the precast column 32 extends toward the precast column 33, and at least one of the extending bars 331 at two sides of the precast column 33 extends toward the precast column 32. The extending bars 311, 321, 331 may be threaded or a threaded at its end.

Figure 2C:
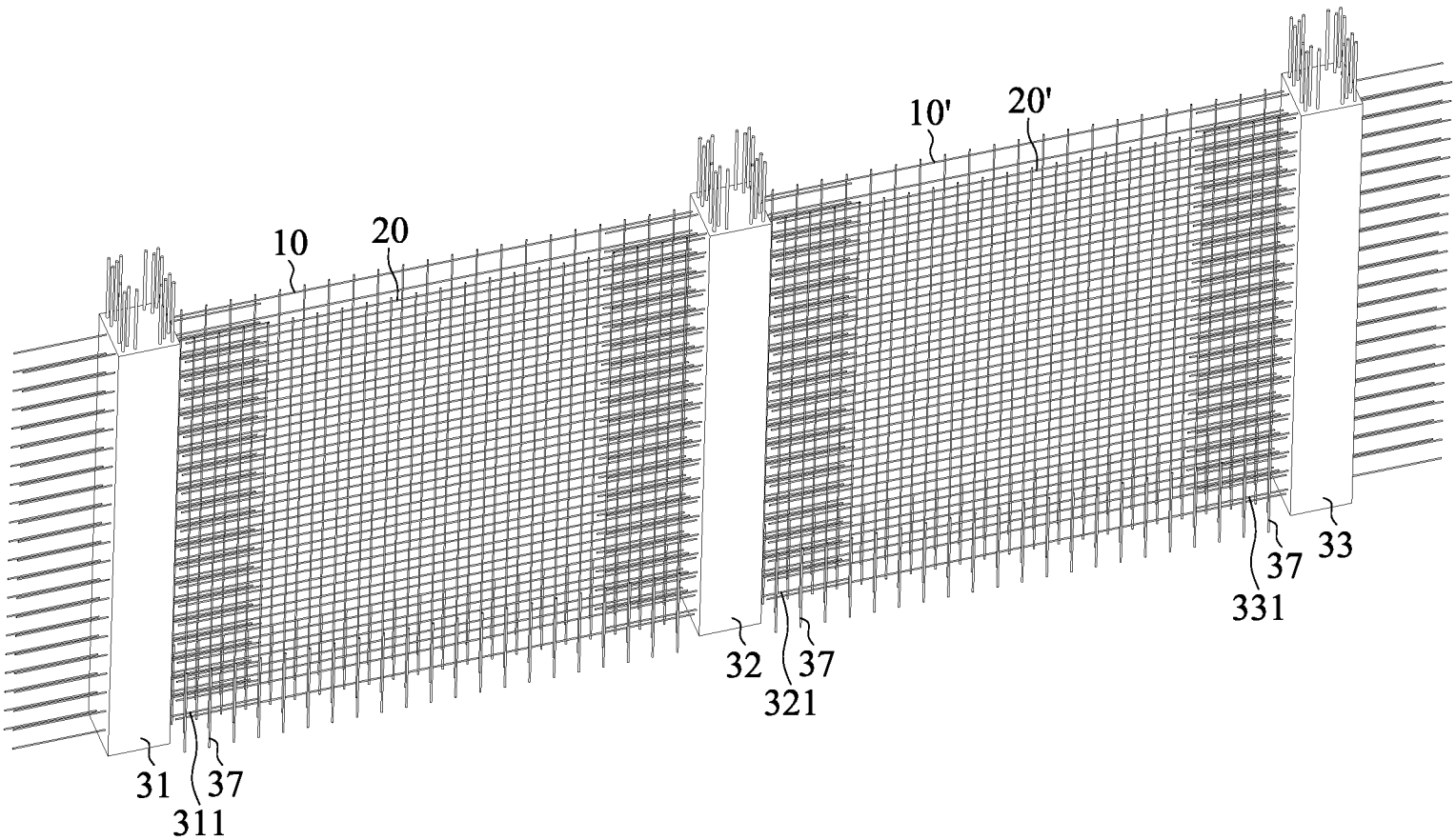
FIG. 2C is a third schematic view showing the construction method in accordance with the embodiment of the present disclosure.

As shown in FIG. 2C, the steel meshes 10, 20 are disposed between the precast column 31 and the precast column 32. Each of the precast columns 31, 32, 33 at each side has two parallel rows of extending bars 311, 321, 331 disposed along the height thereof. The steel mesh 10 and the steel mesh 20 are spaced apart by a predetermined distance, and two sides of the steel mesh 10 are connected to a row of extending bars 311 of the precast column 31 and a row of extending bars 321 of the precast 32 respectively and two sides of the steel mesh 20 are connected to the other row of the extending bars 31 of the precast column 31 and the other row of extending bars 321 of the precast 32 respectively. Moreover, the steel meshes 10', 20' are disposed between the precast column 32 and the precast column 33. The steel mesh 10' and the steel mesh 20' are spaced apart by a predetermined distance, and two sides of the steel mesh 10' are connected to a row of extending bars 321 of the precast column 32 and a row of extending bars 331 of the precast column 33 respectively and two sides of the steel mesh 20' are connected to the other row of extending bars 321 of the precast column 32 and the other row of extending bars 331 of the precast 33 respectively.

Figure 2D:
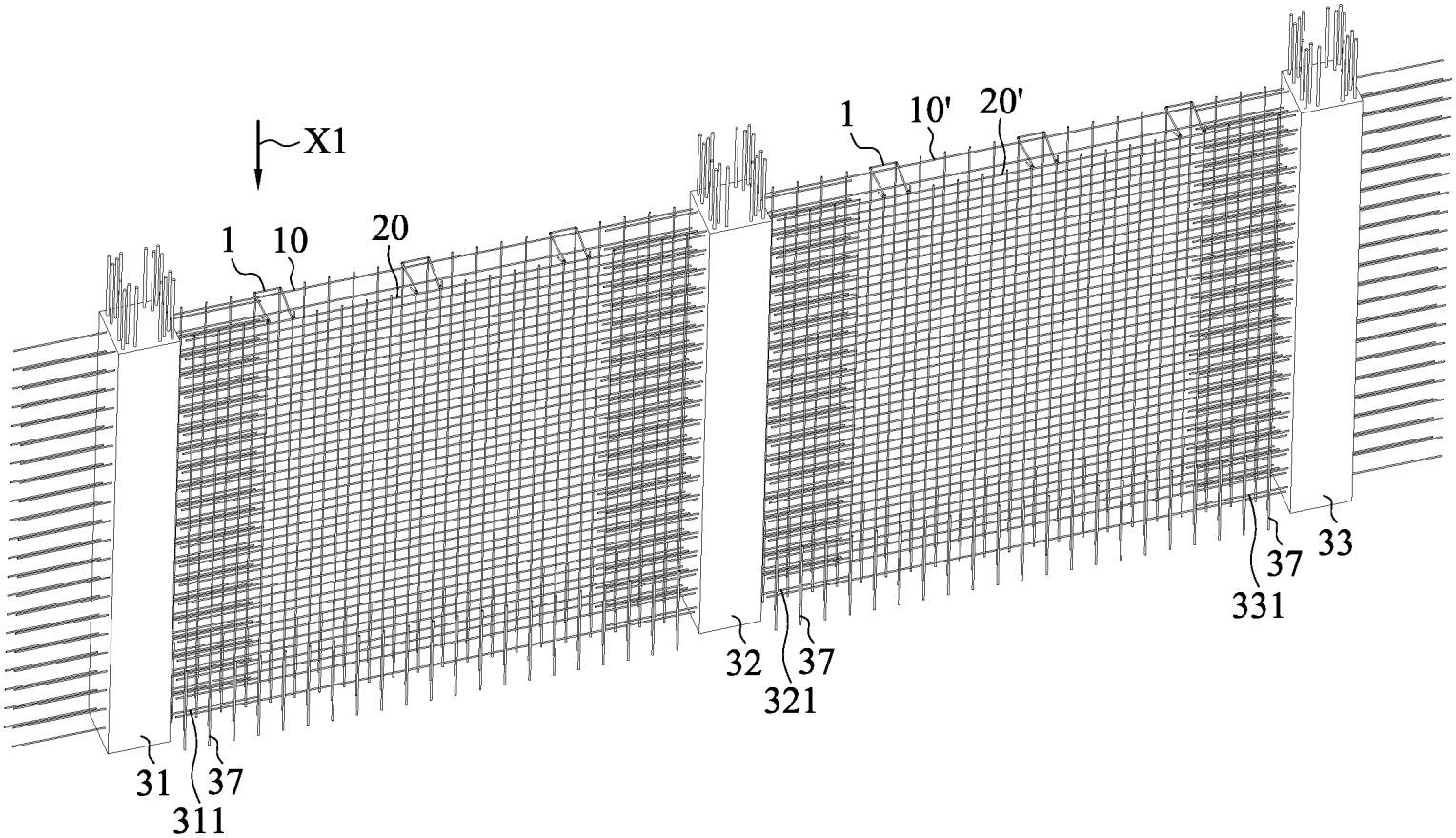
FIG. 2D is a fourth schematic view showing the construction method in accordance with the embodiment of the present disclosure.

As shown in FIG. 2D, the construction method provides one or more tie bars 1 as shown in FIG. 1 between the steel meshes 10 and 20, and the tie bars 1 connect and fix the steel meshes 10 and 20. Further, one or more tie bars 1 as shown in FIG. 1 are also arranged between the steel meshes 10' and 20', and the tie bars 1 to connect and fix the steel meshes 10' and 20'.

Figure 2E:
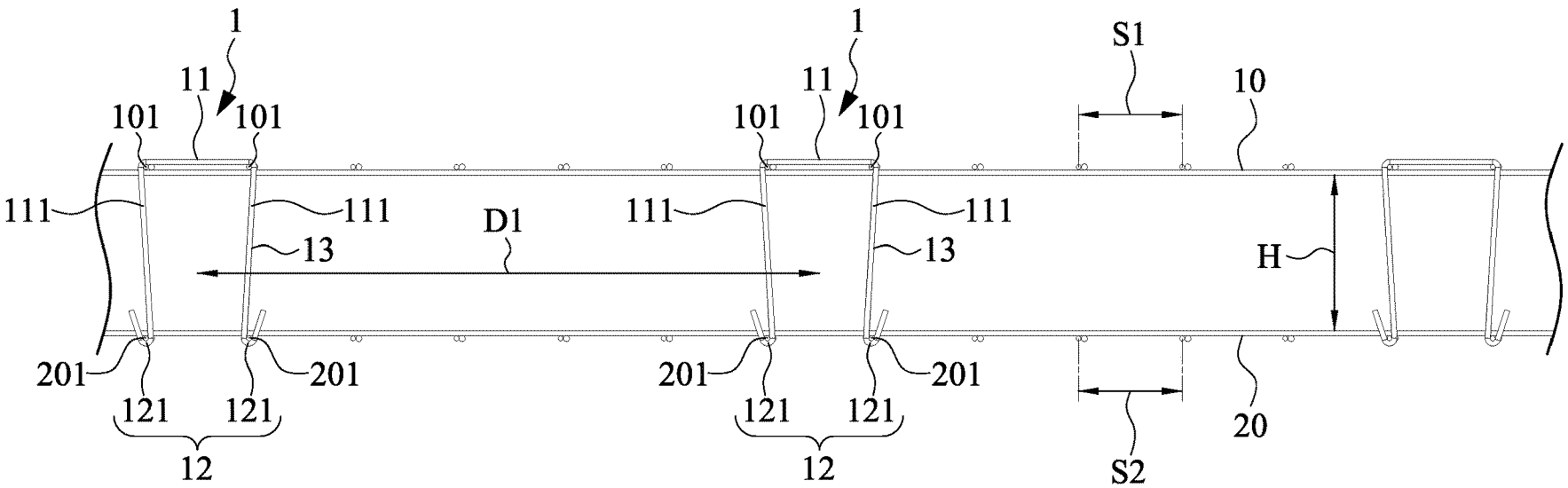
FIG. 2E is a schematic view along an X1 orientation as shown in FIG. 2D.

FIG. 2E is a schematic view along an X1 orientation as shown in FIG. 2D. As shown in FIG. 2E, the steel mesh 10 and the steel mesh 20 are opposite to each other and are spaced apart with a predetermined distance H. The steel mesh 10 includes a plurality of upstanding vertical bars 101 spaced apart by a distance S1. Further, the steel mesh 20 includes a plurality of upstanding vertical bars 201 spaced apart by a distance S2. In some embodiments of the present disclosure, the distance S1 is substantially equal to the distance S2.

Referring to FIG. 2E again, the tie bars 1 as shown in FIG. 1 are arranged to connect the steel mesh 10 and the steel mesh 20. Each of the tie bars 1 connects two adjacent upstanding vertical bars 101 of the steel mesh 10 and two adjacent upstanding vertical bars 201 of the steel mesh 20. The substantially inverted U-shaped first end portion 11 of the tie bar 1 is configured to surround the outer circumferences of the two adjacent upstanding vertical bars 101 of the steel mesh 10. The two bending sections 111 of the first end portion 11 respectively hold or retain the two adjacent upstanding vertical bars 101 of the steel mesh 10. Further, the two hooks 121 of the second portion 12 of the tie bar 1 respectively hook the two adjacent upstanding vertical bars 201 of the steel mesh 20. Moreover, the two connections 13 of the tie bar 1 respectively extend from outer sides of the two adjacent upstanding vertical bars 101 of the steel mesh 10 to the inner sides of the two adjacent upstanding vertical bars 201 of the steel mesh 20. As shown in FIG. 2E, an extending direction of the connection 13 of the tie bar 1 and the extending direction of the steel mesh 10 or the extending direction of the steel mesh 20 form a non-right angle.

In the embodiment shown in FIG. 2E, the orientations of each two adjacent tie bars 1 are the same, and each two adjacent tie bars 1 connect and secure the steel meshes 10 and 20 in the same way. For example, both of them are connected to the two adjacent upstanding vertical bars 101 of the metal mesh 10 with the first end portions 11, and both of them are connected to the two adjacent vertical bars 201 of the metal mesh 20 with the second end portion S12.

Moreover, each two adjacent tie bars 1 are spaced apart by a distance D1 in the transverse direction in FIG. 2E. In some embodiments of the present disclosure, the distance D1 between the two adjacent tie bars is substantially equal to eight times the distance (S1) between two adjacent upstanding vertical bars 101 of the metal mesh 10 or substantially equal to eight times the distance (S2) between two adjacent upstanding vertical bars 201 of the metal mesh 20.

Further, in addition to being arranged in the transverse direction in FIG. 2E, some of the plurality of tie bars 1 (not shown) are arranged lengthwise along the upstanding vertical bars 101 of the metal mesh 10 or lengthwise along the upstanding vertical bars 201 of the metal mesh 20. In some embodiments of the present disclosure, another tie bar 1 (not shown), the same as or similar to the tie bar 1 as shown in FIG. 1, is arranged underneath a tie bar 1 shown in FIG. 2E by another predetermined distance, and the substantially inverted U-shaped first end portion of the lower tie bar is configured to surround the two adjacent upstanding vertical bars 101 of the metal mesh 10 and the two hooks of the second end portion of the lower tie bar respectively hook the two adjacent upstanding vertical bars 201 of the metal mesh 20. That is, the orientations of the upper tie bar and the lower tie bar are the same, and the upper tie bar and the lower tie bar connect the steel meshes 10, 20 in the same way.

Figure 2F:
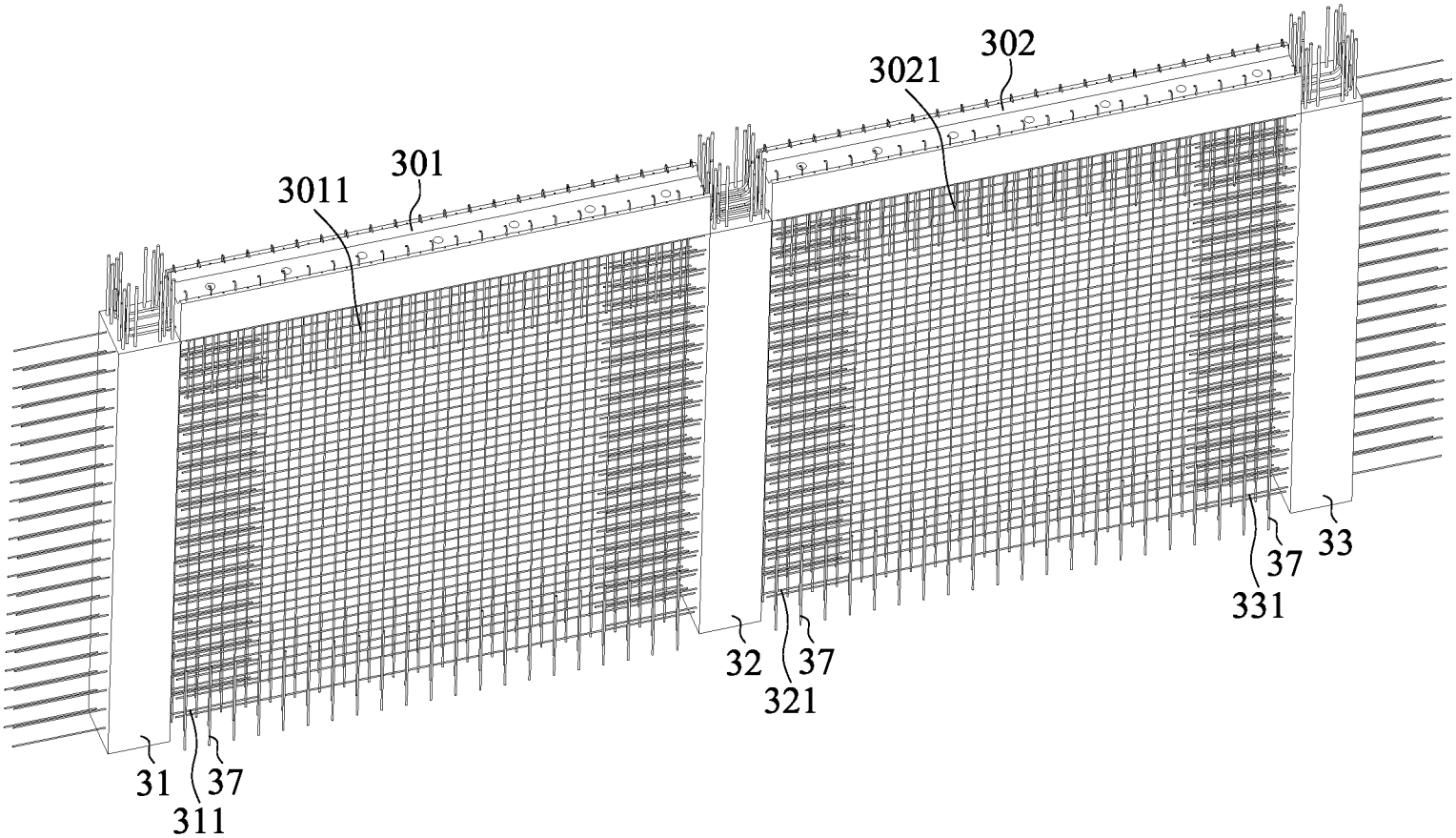
FIG. 2F is a fifth schematic view showing the construction method in accordance with the embodiment of the present disclosure.

As shown in FIG. 2F, a precast beam 301 is disposed above the steel mesh 10 and the steel mesh 20 and extends between the upper end of the precast column 31 and the upper end of the precast column 32. The precast beam 301 at its lower side has extending bars 3011 for connection with the steel meshes 10, 20, and there is a distance of around 5 cm (not shown) between the lower surface of the precast beam 301 and the top of the steel mesh 10 or that of the steel mesh 20. Moreover, a precast beam 302 is disposed above the steel mesh 10' and the steel mesh 20' and extends between the upper end of the precast column 32 and the upper end of the precast column 33. The precast beam 302 at its lower side has extending bars 3021 for connection with the steel meshes 10', 20', and there is a distance of around 5 cm (not shown) between the lower surface of the precast beam 302 and the top of the steel mesh 10' or that of the steel mesh 20'. In some embodiments of the present disclosure, the precast beam 301, 302 is a fully prefabricated beam or a semi-precast beam.

Figure 2G:
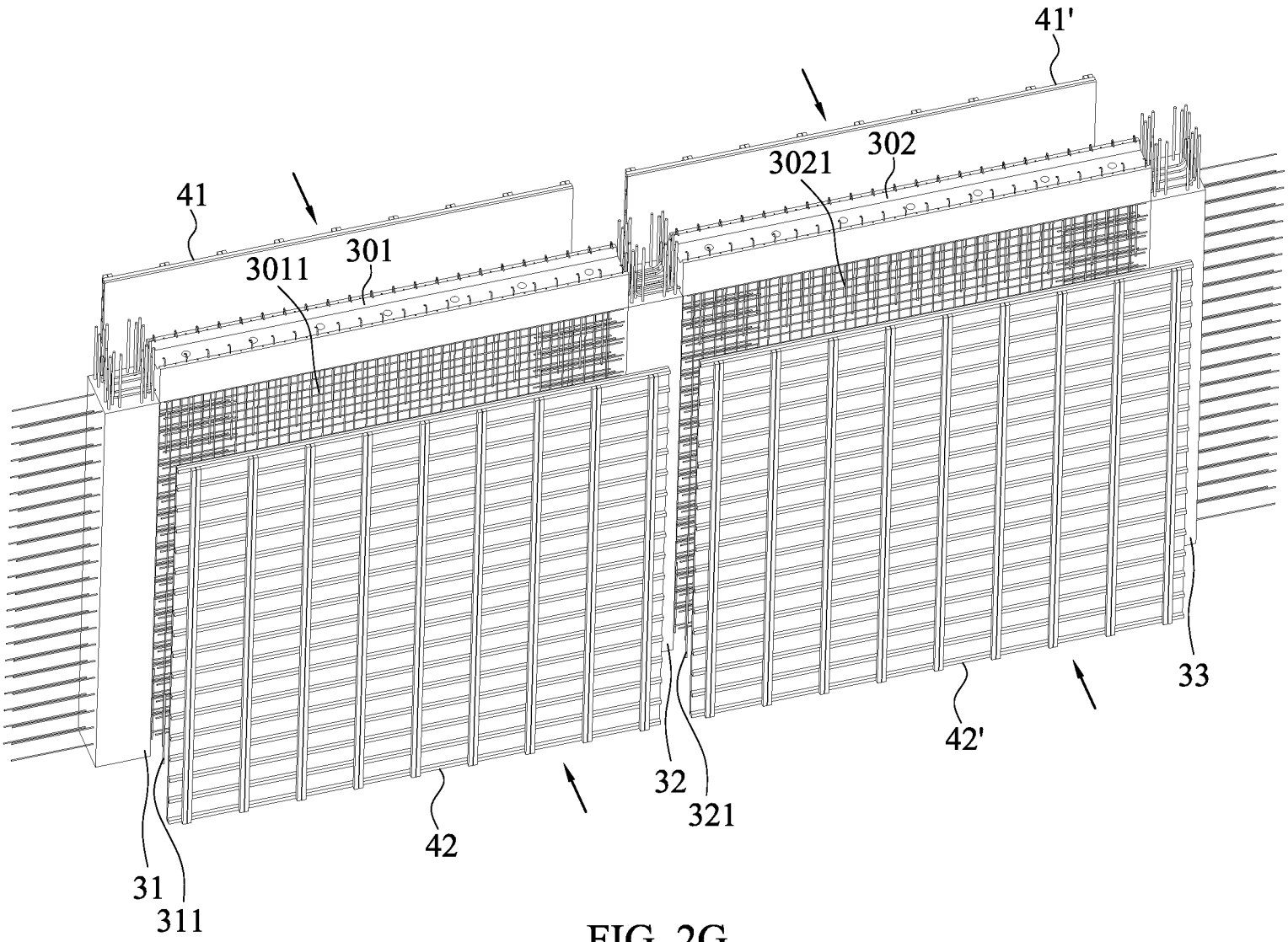
FIG. 2G is a sixth schematic view showing the construction method in accordance with the embodiment of the present disclosure.
Figure 2H:
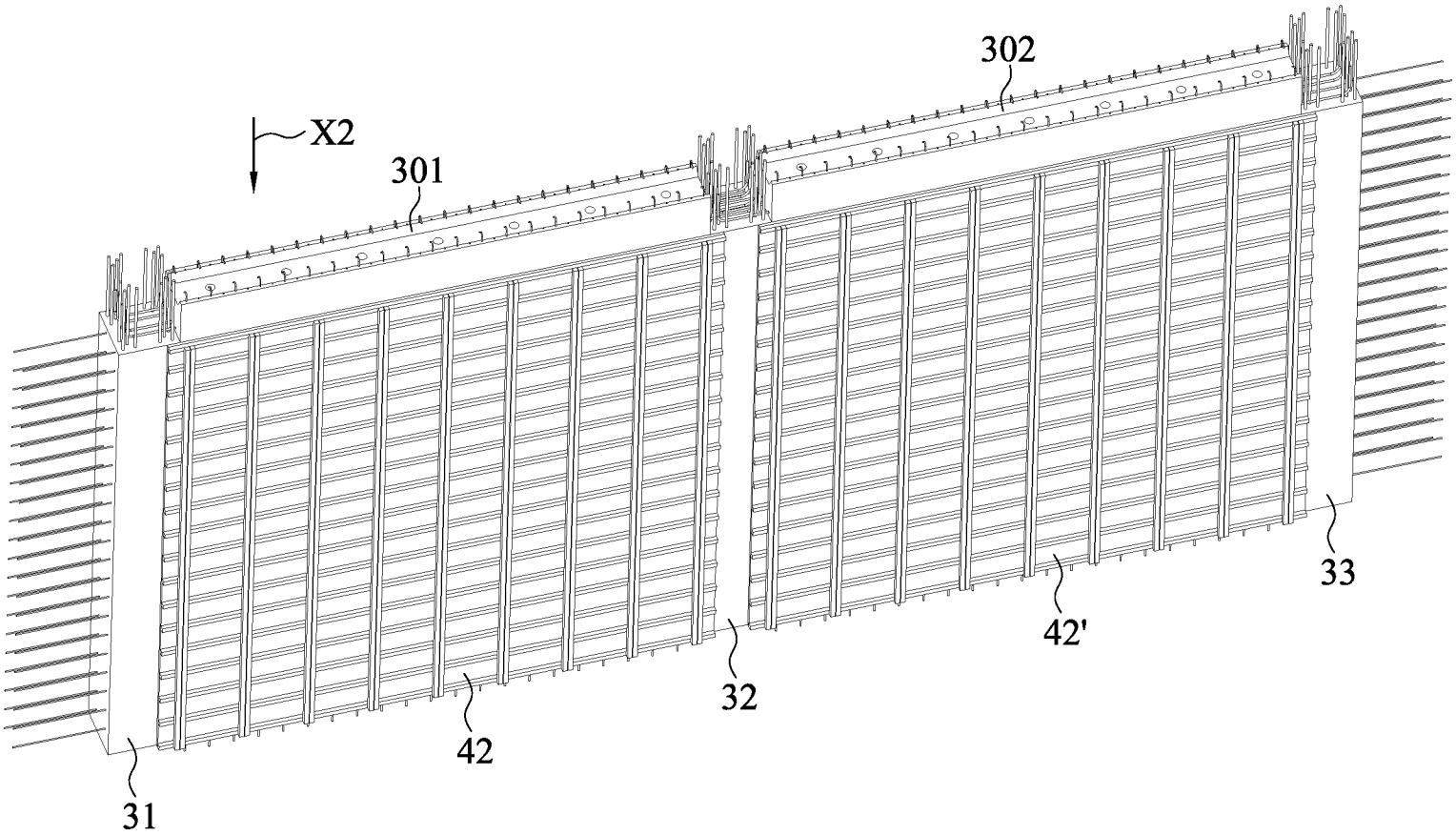
FIG. 2H is a seventh schematic view of a construction method in accordance with the embodiment of the present disclosure.

As shown in FIGS. 2G, 2H, the construction method of the present disclosure provides formworks 41, 42, 41', 42'. The formworks 41 and 42 are disposed so that the steel meshes 10 and 20 are received therebetween. In other words, the steel meshes 10 and 20 are disposed between the formworks 41 and 42. The formworks 41' and 42' are disposed so that the steel meshes 10' and 20' are received therebetween. In other words, the steel meshes 10' and 20' are disposed between the formworks 41' and 42'.

Figure 2I:
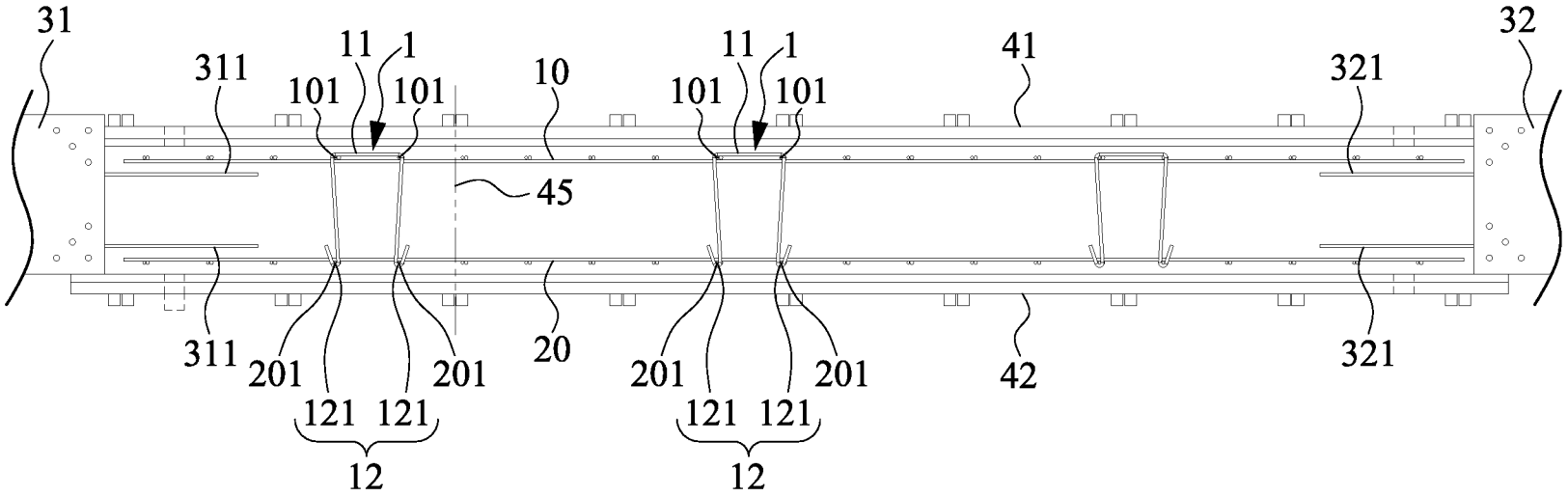
FIG. 2I is a schematic view along an X2 orientation as shown in FIG. 2H.

FIG. 2I is a schematic view along an X2 orientation as shown in FIG. 2H. As shown in FIG. 2I, the steel meshes 10 and 20 are parallel to each other and are disposed between the precast columns 31 and 32. The two sides of steel meshes 10 and 20 are connected to the extending bars 311 of the precast column 31 and the extending bars 321 of the precast column 32. A plurality of tie bars 1 connect and secure the steel meshes 10 and 20 in the manner as shown in FIG. 2D. As shown in FIG. 2I, the formworks 41 and 42 are configured to receive the steel meshes 10 and 20 therebetween. Further, a plurality of pulling sheets 45 connect the formworks 41 and 42. Each of the pulling sheets 45 is configured to pass through the formwork 41 and the formwork 42, and its two ends are fixed to the formwork 41 and the formwork 42 thereby tightening the formwork 41 and the formwork 42.

Figure 2J:
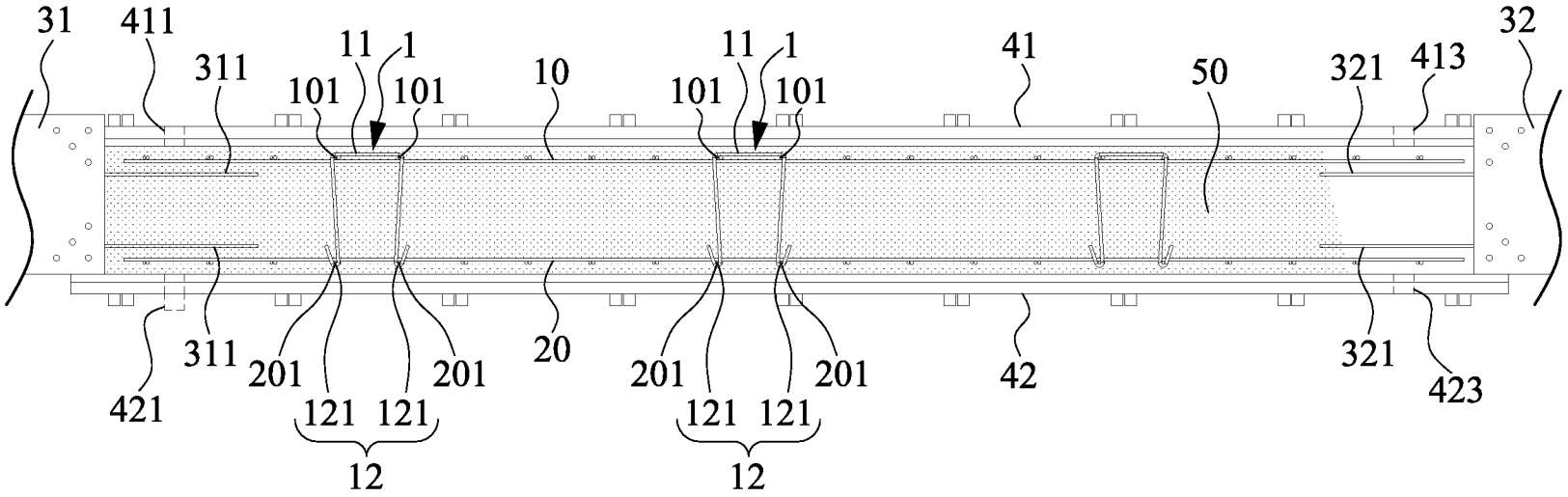
FIG. 2J is an eighth schematic view showing the construction method in accordance with the embodiment of the present disclosure.
Figure 2K:
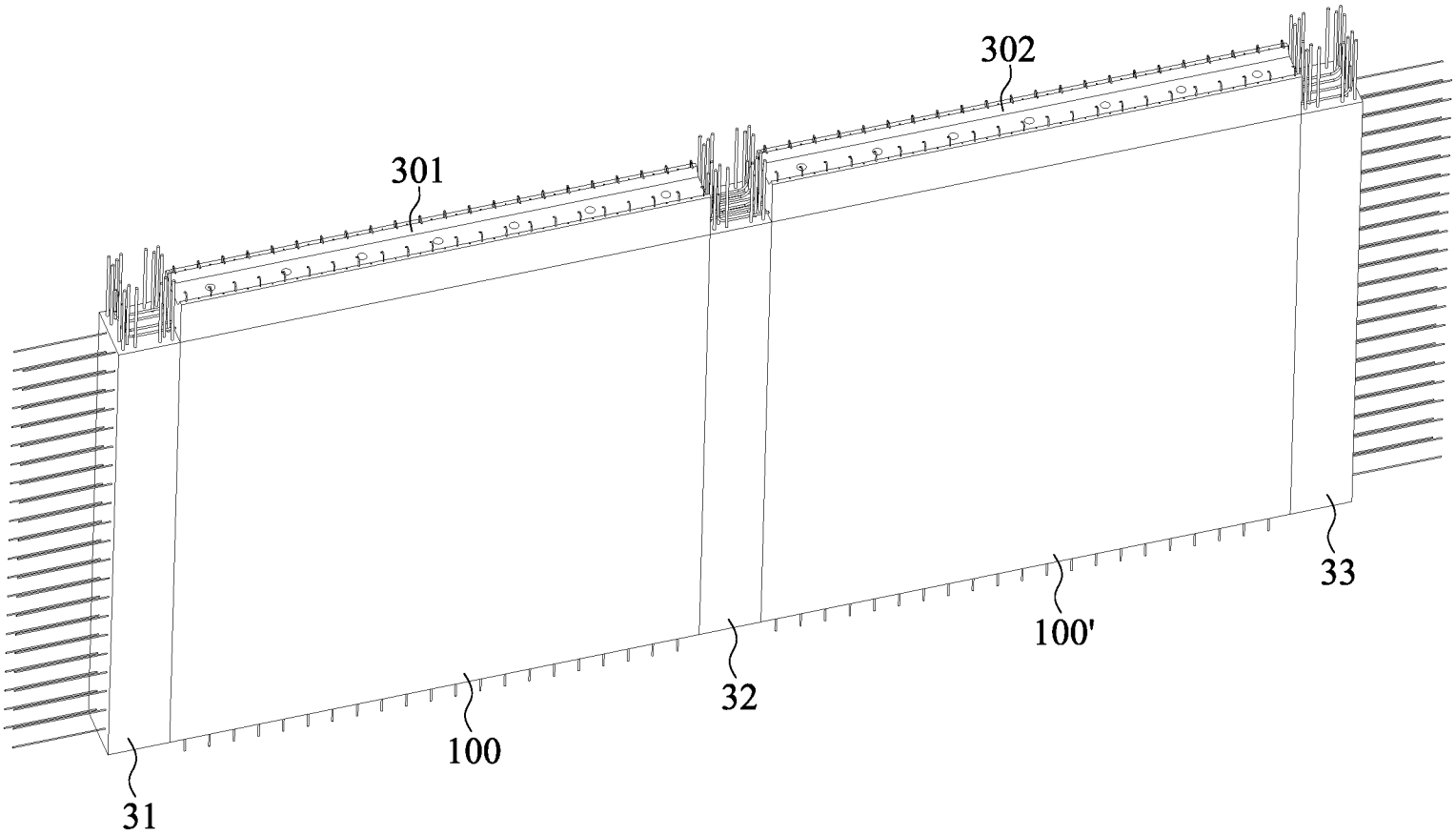
FIG. 2K is a ninth schematic view showing the construction method in accordance with the embodiment of the present disclosure.

As shown in FIG. 2J, the formwork 41 has outlets 411, 413 adjacent to its upper end and the formworks 42 has inlet 421 and outlet 423 adjacent to its upper end. The concrete 50 is poured between the formworks 41 and 42 and between formworks 41' and 42' (not shown). Taking the embodiment shown in FIG. 2J as an example, the concrete 50 is poured into the space between the formworks 41 and 42 through the inlet 421 of the formwork 42. When the concrete 50 is poured into the space between the formworks 41 and 42 until reaching a level close to the upper ends of the formworks 41 and 42, air and a small amount of excess concrete 50 is expelled from the outlets 411, 413, 423. When the small amount of the concrete 50 is expelled from the outlets 411, 413, 423, it signifies that the air has been removed and the concrete pouring can stop. In addition, after the initial setting of the concrete 50, expansive-cement mortar is poured into a space (not shown) between the lower surface of the precast beam 301 and the tops of the steel mesh 10, 20 and a space (not shown) between the lower surface of the precast beam 302 and the tops of the steel mesh 10', 20', which is around 5 cm in height. FIG. 2K shows a shear wall 100 and a shear wall 100' which are formed after the concrete 50 is solidified and formed and the formworks 41, 42 and the formworks 41' and 42' in FIG. 2G are removed.

FIGS. 3A-3K are a series of schematic views illustrating a construction method for manufacturing shear walls 200 and 200' by using the tie bar 1 according to another embodiment of the present disclosure.

Figure 3A:
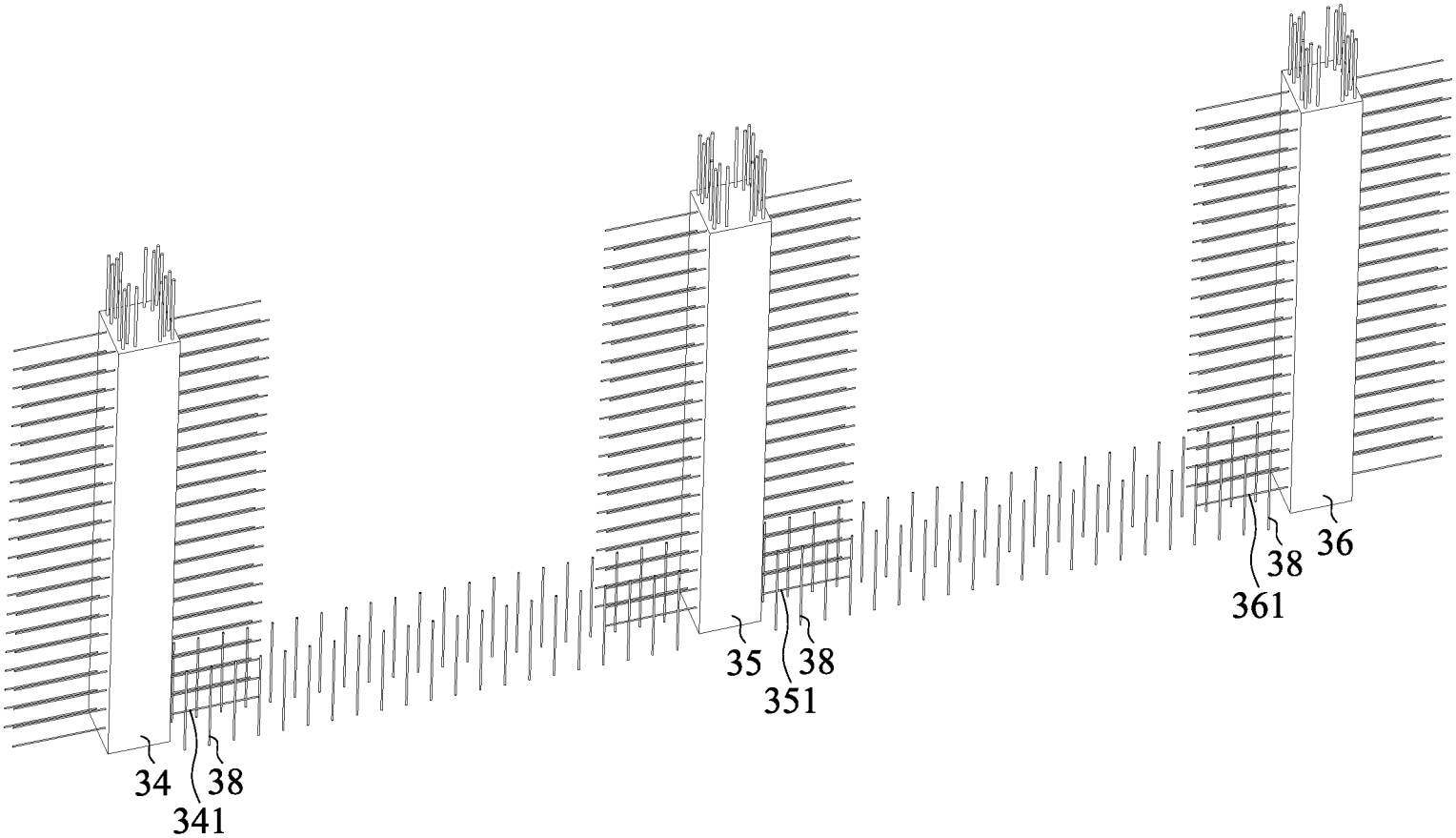
FIG. 3A is a first schematic view showing a construction method in accordance with another embodiment of the present disclosure.

As shown in FIG. 3A, the construction method of the another embodiment provides several precast columns 34, 35, 36 on a building site, and the precast columns 34, 35, 36 are spaced apart by a predetermined distance. In some embodiments of the present disclosure, the distance between the precast columns 34 and the precast columns 35 is greater than, equal to, or less than the distance between the precast columns 35 and the precast columns 36. A plurality of vertical steel bars 38 are arranged on the building site and between the pillars 34, 35 and 36 for connecting with and fixing to the bottom sides of the steel mesh 60 and the steel mesh 70 (see FIGS. 3C and 3D).

Figure 3B:
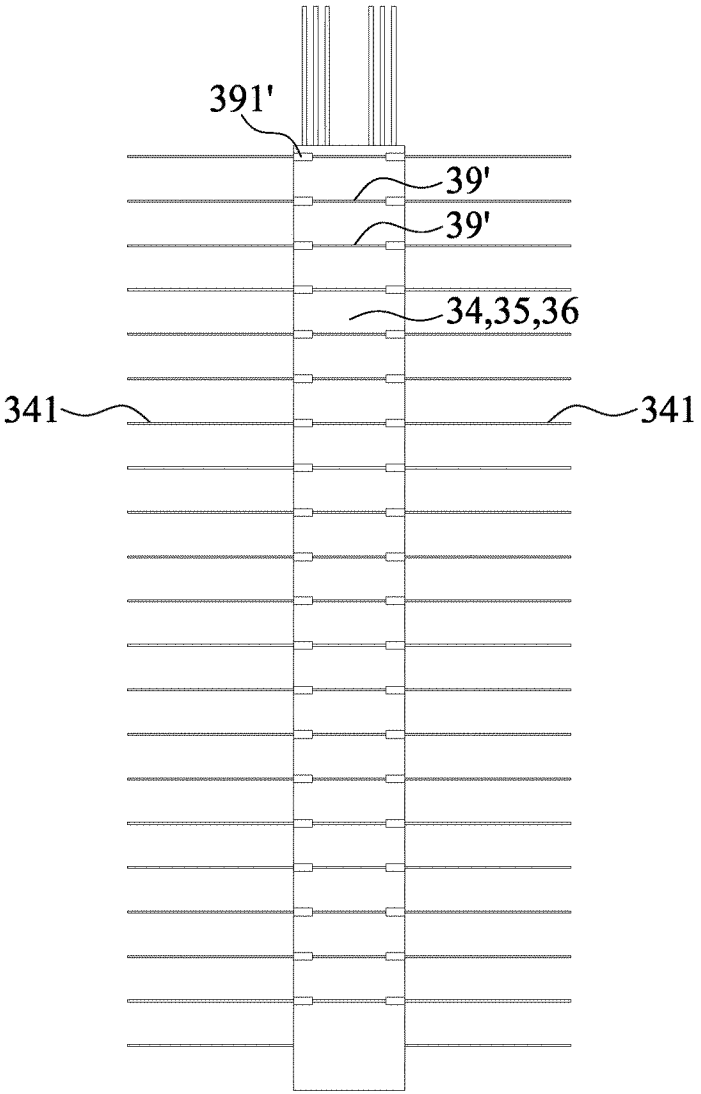
FIG. 3B is a second schematic view showing the construction method in accordance with said another embodiment of the present disclosure.

Referring to FIG. 3B, each of the precast columns 34, 35, 36 is provided with a plurality of tension bars 39' disposed along the height and width (not shown) of the precast columns 34, 35, 36. Each of the tension bars 39' is provided with nut heads 391', configured to connect bars. A plurality of extending bars 341 are respectively connected with the nut heads 391' of the corresponding tension bars 39' as extensions to connect with the two sides of the steel mesh 60 and the steel mesh 70 (see FIGS. 3C and 3D). In some embodiments of the present disclosure, at least one of the extending bars 341 at two sides of the precast column 31 extends toward the precast column 35, and at least one of the extending bars 351 at two sides of the precast column 35 extends toward the precast column 34, and at least one of the extending bars 351 at two sides of the precast column 35 extends toward the precast column 36, and at least one of the extending bars 361 at two sides of the precast column 36 extends toward the precast column 35. The extending bars 341, 351, 361 may be threaded or threaded at the ends.

Figure 3C:
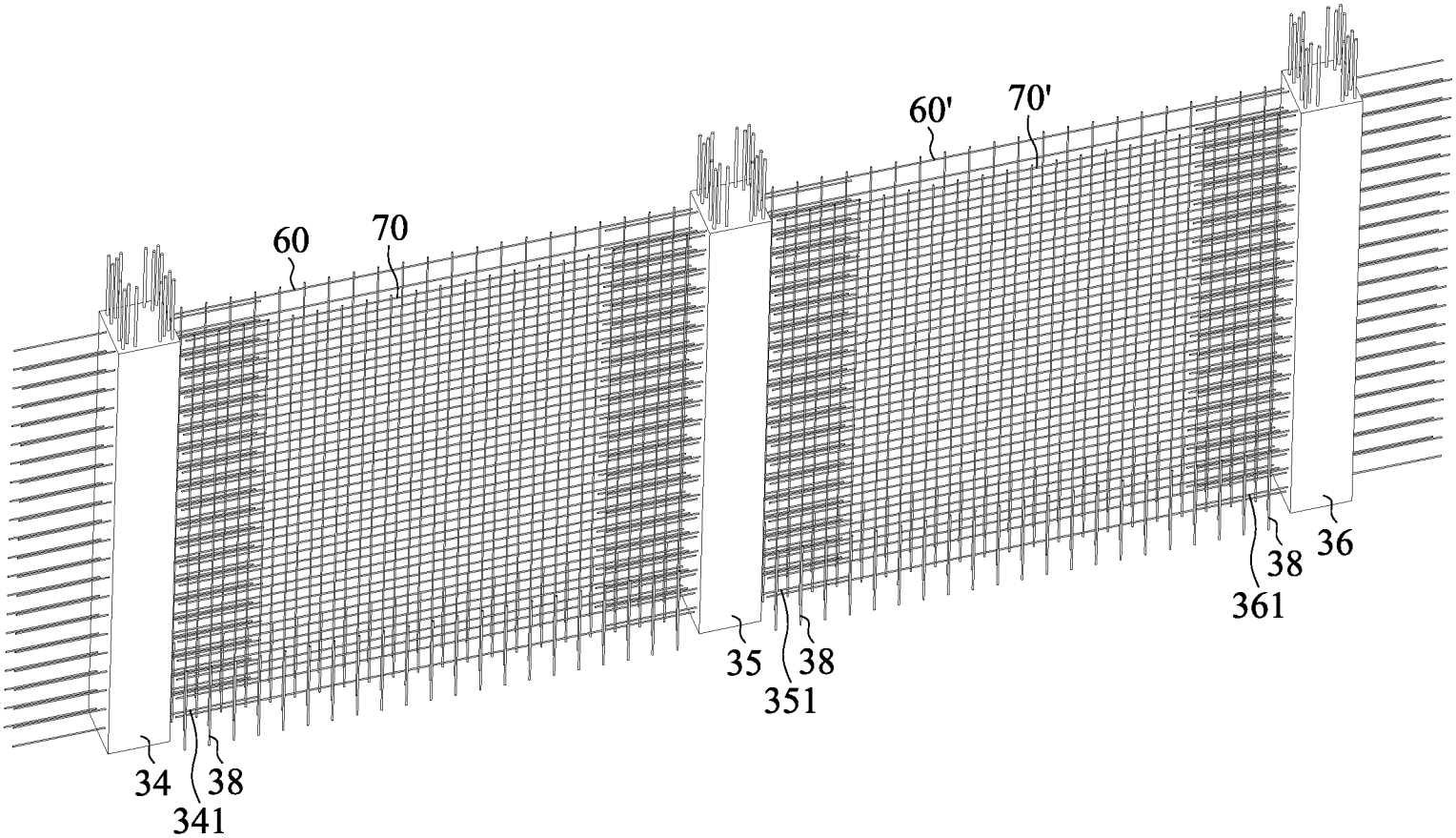
FIG. 3C is a third schematic view showing the construction method in accordance with said another embodiment of the present disclosure.

As shown in FIG. 3C, the steel meshes 60, 70 are disposed between the precast column 34 and the precast column 35. The steel mesh 60 and the steel mesh 70 are spaced apart by a predetermined distance, and two sides of the steel mesh 60 are connected to the extending bars 341 of the precast column 34 and the extending bars 351 of the precast 35 respectively and two sides of the steel mesh 70 are connected to the other extending bars 34 of the precast column 34 and the other extending bars 351 of the precast 35 respectively. Moreover, the steel meshes 60', 70' are disposed between the precast column 35 and the precast column 36. The steel mesh 60' and the steel mesh 70' are spaced apart by a predetermined distance, and two sides of the steel mesh 60' are connected to the extending bars 351 of the precast column 35 and the extending bars 361 of the precast column 36 respectively and two sides of the steel mesh 70' are connected to the other extending bars 351 of the precast column 35 and the other extending bars 361 of the precast 36 respectively.

Figure 3D:
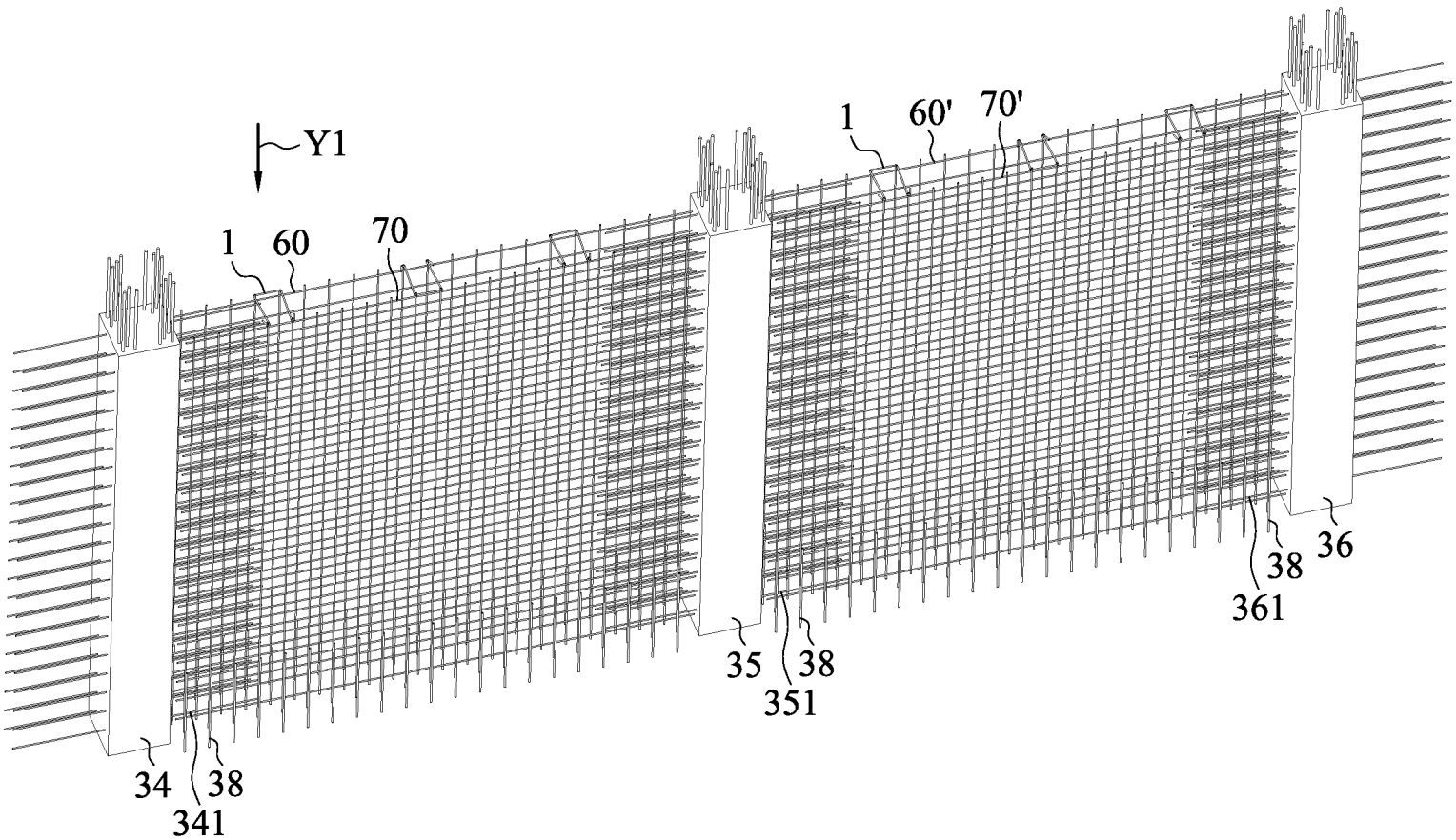
FIG. 3D is a fourth schematic view showing the construction method in accordance with said another embodiment of the present disclosure.

As shown in FIG. 3D, the construction method provides one or more tie bars 1 as shown in FIG. 1 between the steel meshes 10 and 20, and the tie bars 1 are connected with and fixed to the steel meshes 10 and 20. Further, one or more tie bars 1 as shown in FIG. 1 are also arranged to be disposed between the steel meshes 10' and 20' for connection with and fixing to the steel meshes 10' and 20'.

Figure 3E:
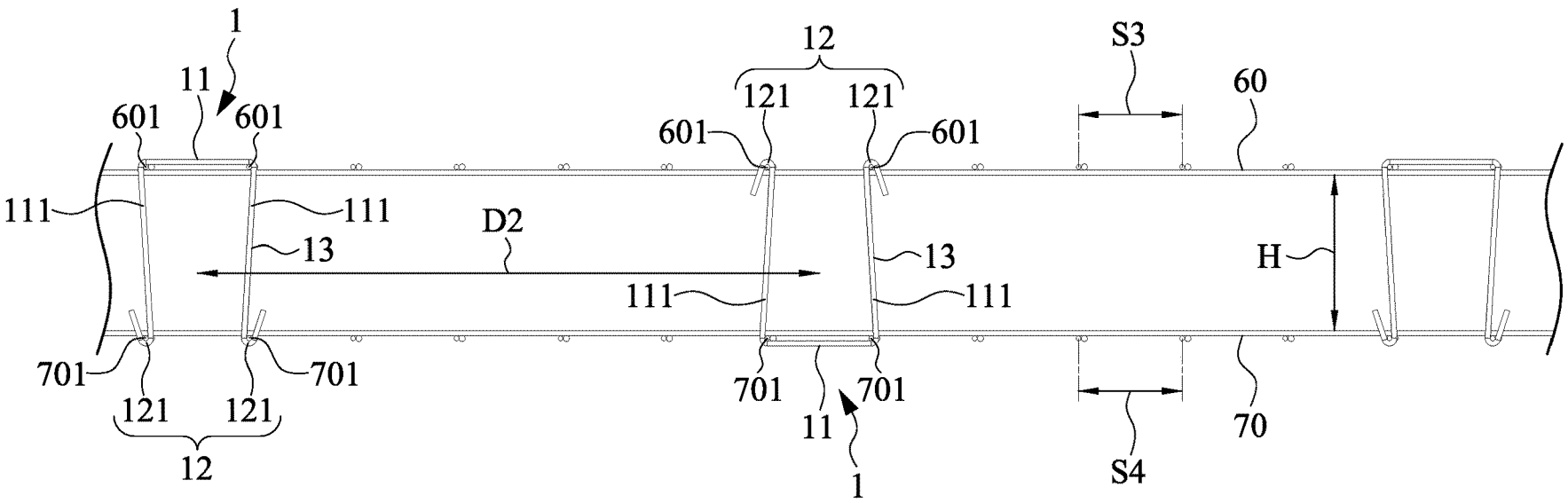
FIG. 3E is a schematic view from a perspective along a Y1 orientation as shown in FIG. 3D.

FIG. 3E is a schematic view along a Y1 orientation as shown in FIG. 3D. As shown in FIG. 3E, the steel mesh 60 and the steel mesh 70 are opposite to each other and spaced apart by a predetermined distance. The steel mesh 60 includes a plurality of upstanding vertical bars 601 spaced apart by a distance S3. Further, the steel mesh 70 includes a plurality of upstanding vertical bars 701 spaced apart by a distance S4. In some embodiments of the present disclosure, the distance S3 is substantially equal to the distance S4.

Please refer to FIG. 3E. The tie bars 1 as shown in FIG. 1 are configured to connect the steel mesh 60 and the steel mesh 70. The tie bars 1 shown in FIG. 3E connect the two adjacent upstanding vertical bars 601 of the steel mesh 60 and the two adjacent upstanding vertical bars 701 of the steel mesh 70 such that the steel meshes 60 and 70 are connected and secured to each other. The substantially inverted U-shaped first end portion 11 of the tie bar 1 is configured to surround the outer circumferences of e two adjacent upstanding vertical bars 601 of the steel mesh 60. The two bending sections 111 of the first end portion 11 may respectively hold or retain two adjacent upstanding vertical bars 601 of the steel mesh 60. Further, the two hooks 121 of the second portion 12 of the tie bar 1 respectively hook two adjacent upstanding vertical bars 701 of the steel mesh 70. Moreover, the two connections 13 of the tie bar 1 respectively extend from the outer sides of the two adjacent upstanding vertical bars 601 of the steel mesh 60 to the inner sides of two adjacent upstanding vertical bars 701 of the steel mesh 70. As shown in FIG. 3E, the extending direction of the connection 13 of the tie bar 1 and the extending direction of the steel mesh 60 and/or the steel mesh 60 form a non-right angle.

As shown in FIG. 3E, the central tie bar 1 between the left side tie bar 1 and the right side tie bar 1 has an orientation different from that of the left side tie bar 1 and that of the right side tie bar 1. The substantially inverted U-shaped first end portion 11 of the central tie bar 1 is configured to surround the outer circumferences of two adjacent upstanding vertical bars 701 of the steel mesh 70. The two bending sections 111 of the first end portion 11 respectively hold or retain two adjacent upstanding vertical bars 701 of the steel mesh 70. Further, the two hooks 121 of the second portion 12 of the central tie bar 1 respectively hook two adjacent upstanding vertical bars 601 of the steel mesh 60. Furthermore, the two connections 13 of the central tie bar 1 respectively extend from outer sides of two adjacent upstanding vertical bars 701 of the steel mesh 70 to the inner sides of the two adjacent upstanding vertical bars 601 of the steel mesh 60. As shown in FIG. 3E, the extending direction of the connection 13 of the tie bar 1 and the extending direction of the steel mesh 60 and/or the steel mesh 60 form a non-right angle. In other words, in this embodiment, two adjacent tie bars 1 have opposite orientations. For example, when a tie bar 1 connects the two adjacent upstanding vertical bars 601 of the steel mesh 60 with its first end portion 11 and connects the two adjacent upstanding vertical bars 701 of the steel mesh 70 with the second end portion 12, the other tie bar 1 connects the two adjacent upstanding vertical bars 701 of the steel mesh 70 with its first end portion 11 and connects the two adjacent upstanding vertical bars 601 of the steel mesh 60 with the second end portion 12

Moreover, two adjacent tie bars 1 are spaced apart by a distance D2 in the transverse direction in FIG. 3E. In some embodiments of the present disclosure, the distance between the two adjacent tie bars is substantially equal to eight times the distance S3 between the two adjacent upstanding vertical bars 601 of the metal mesh 60 or substantially equal to eight times the distance S4 between the two adjacent upstanding vertical bars 801 of the metal mesh 80.

Further, in addition to being disposed in the transverse direction in FIG. 3E, some of the plurality of tie bars 1 (not shown) are arranged lengthwise along the upstanding vertical bar 601 of the metal mesh 60 or lengthwise along the upstanding vertical bar 701 of the metal mesh 70. In some embodiments of the present disclosure, another tie bar 1 (not shown), which is the same as or similar to the tie bar 1 as shown in FIG. 1, is disposed underneath a tie bar 1 shown in FIG. 2E by another predetermined distance. Moreover, the structures and the orientations of the upper tie bar 1 and the lower tie bar 1 may be the same. In some embodiments of the present disclosure, the structures and the orientations of the upper tie bar 1 and the lower tie bar 1 are different.

Figure 3F:
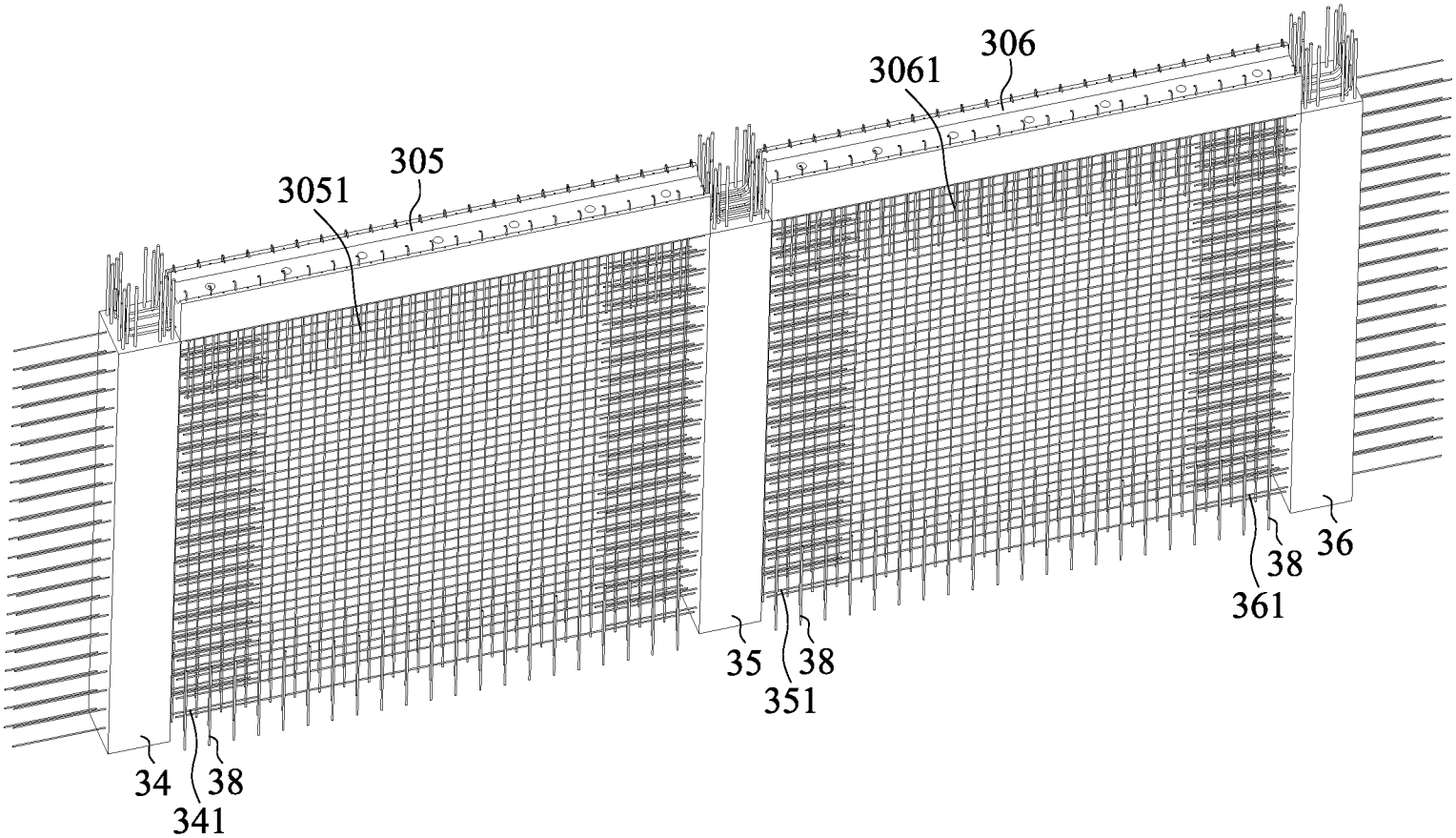
FIG. 3F is a fifth schematic view showing the construction method in accordance with said another embodiment of the present disclosure.

As shown in FIG. 3F, a precast beam 305 is disposed above the steel mesh 60 and the steel mesh 70 and extends between the upper end of the precast column 34 and the upper end of the precast column 35. The precast beam 305 at its lower side has extending bars 3051 for connection with the steel meshes 60, and there is a distance of around 5 cm (not shown) between the lower surface of the precast beam 305 and the top of the steel mesh 60 or the steel mesh 70. Moreover, a precast beam 306 is disposed above the steel mesh 60' and the steel mesh 70' and extends between the upper end of the precast column 35 and the upper end of the precast column 36. The precast beam 306 at its lower side has extending bars 3061 for connection to the steel meshes 60', 70', and there is a distance of around 5 cm (not shown) between the lower surface of the precast beam 306 and the top of the steel mesh 60' or the steel mesh 70'. In some embodiments of the present disclosure, the precast beam 305, 306 is a fully prefabricated beam or a semi-precast beam.

Figure 3G:
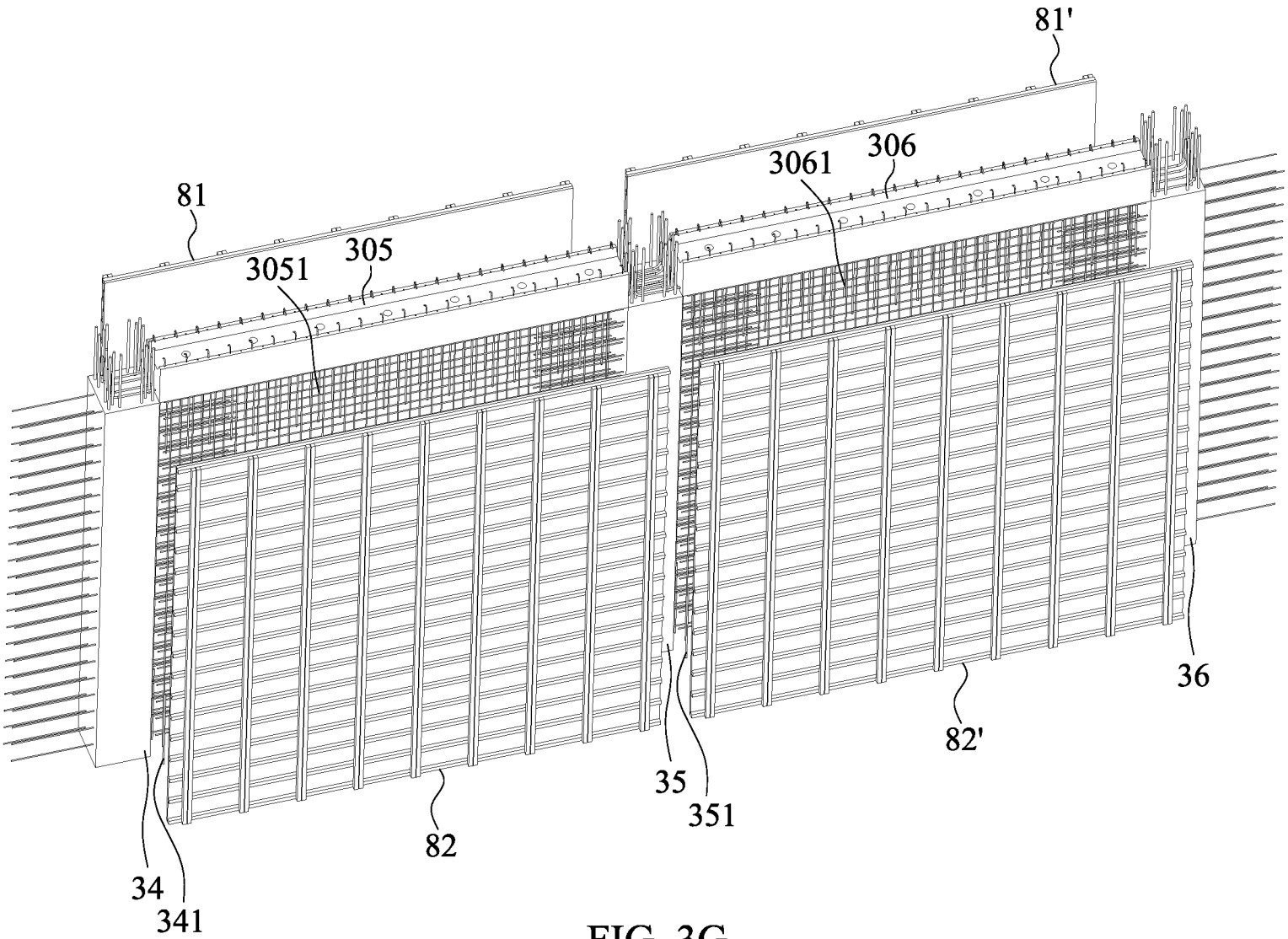
FIG. 3G is a sixth schematic view showing the construction method in accordance with said another embodiment of the present disclosure.
Figure 3H:
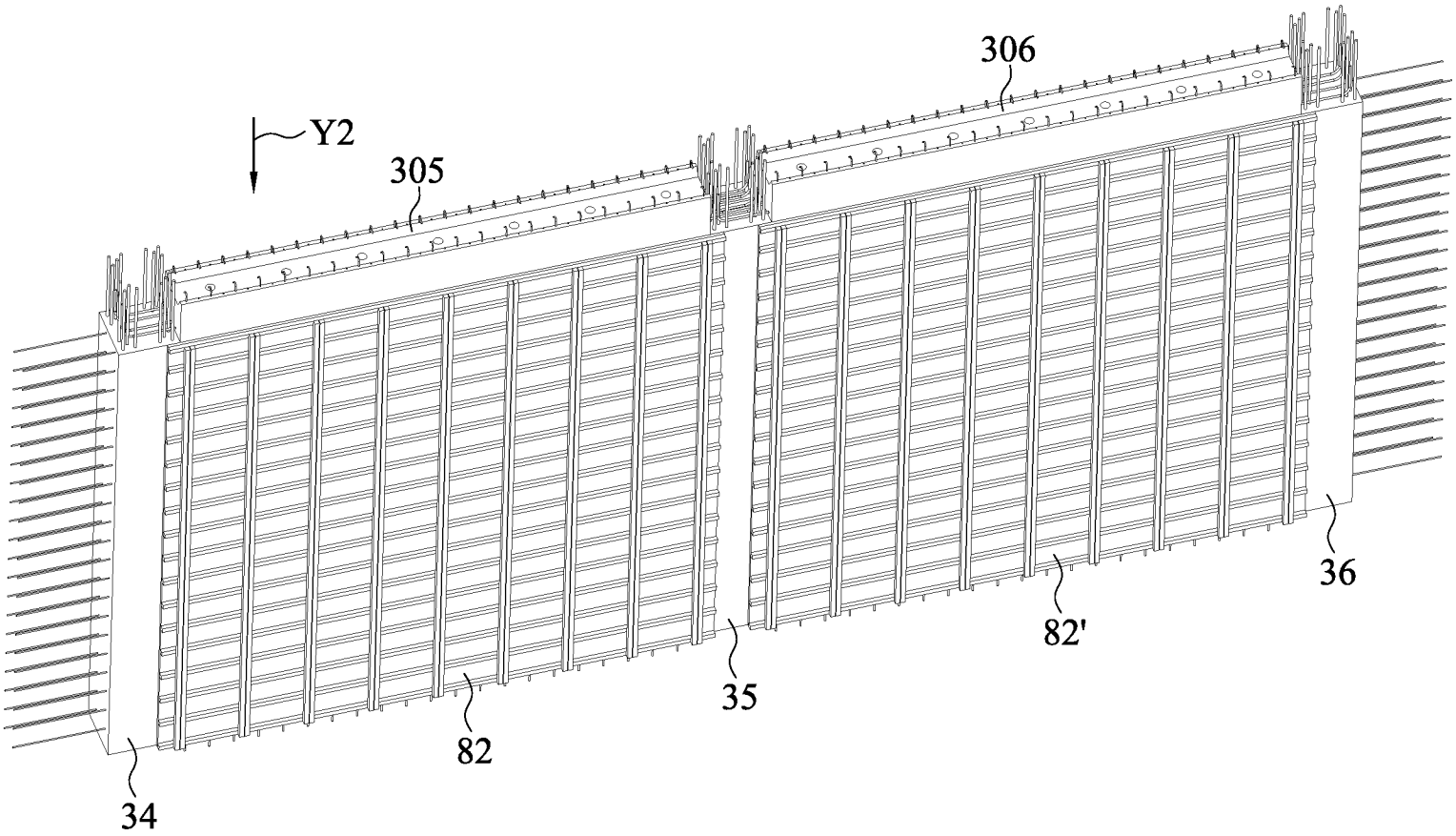
FIG. 3H is a seventh schematic view showing the construction method in accordance with said another embodiment of the present disclosure.

As shown in FIGS. 3G, 3H, the construction method of the present disclosure provides formworks 81, 82, 81', 82'. The formworks 81 and 82 are disposed so that the steel meshes 60 and 70 are received therebetween. In other words, the steel meshes 60 and 70 are disposed between the formworks 81 and 82. The formworks 81' and 82' are disposed so that the steel meshes 60' and 70' are received therebetween. In other words, the steel meshes 60' and 70' are disposed between the formworks 81' and 82'.

Figure 3I:
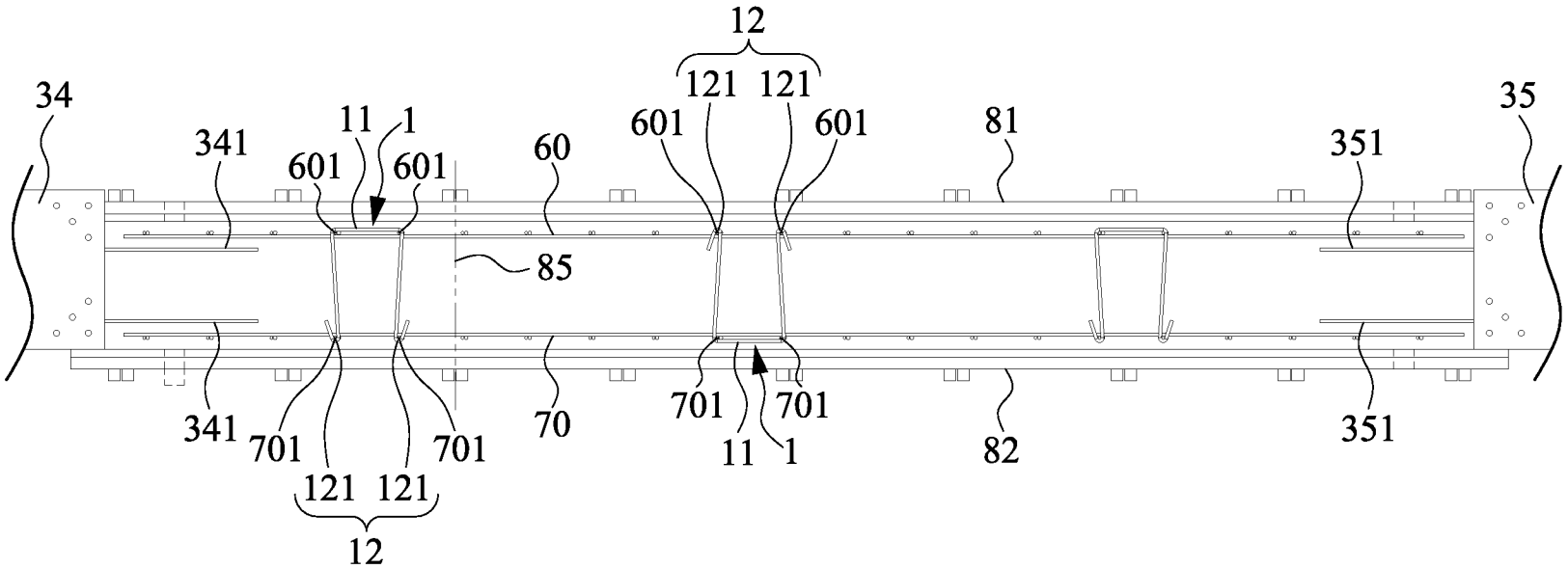
FIG. 3I is a schematic view from a perspective along a Y2 orientation as shown in FIG. 3H.

FIG. 3I is a schematic view from a perspective along a Y2 orientation as shown in FIG. 3H. As shown in FIG. 3I, the steel meshes 60 and 70 are parallel to each other and are disposed between the precast columns 34 and 35, and two sides of the steel meshes 60 and 70 are connected to the extending bars 341 of the precast column 34 and the extending bars 351 of the precast column 35. A plurality of tie bars 1 connect the steel meshes 60 and 70 in the manner as shown in FIG. 3D. As shown in FIG. 3I, the formworks 81 and 82 are configured to receive the steel meshes 60 and 70 therebetween. Further, a plurality of pulling sheets 85 connect the formworks 81 and 82. The pulling sheet 85 is configured to pass through the formwork 81 and the formwork 82, and its two ends are fixed to the formwork 81 and the formwork 82 thereby tightening the formwork 81 and the formwork 82.

Figure 3J:
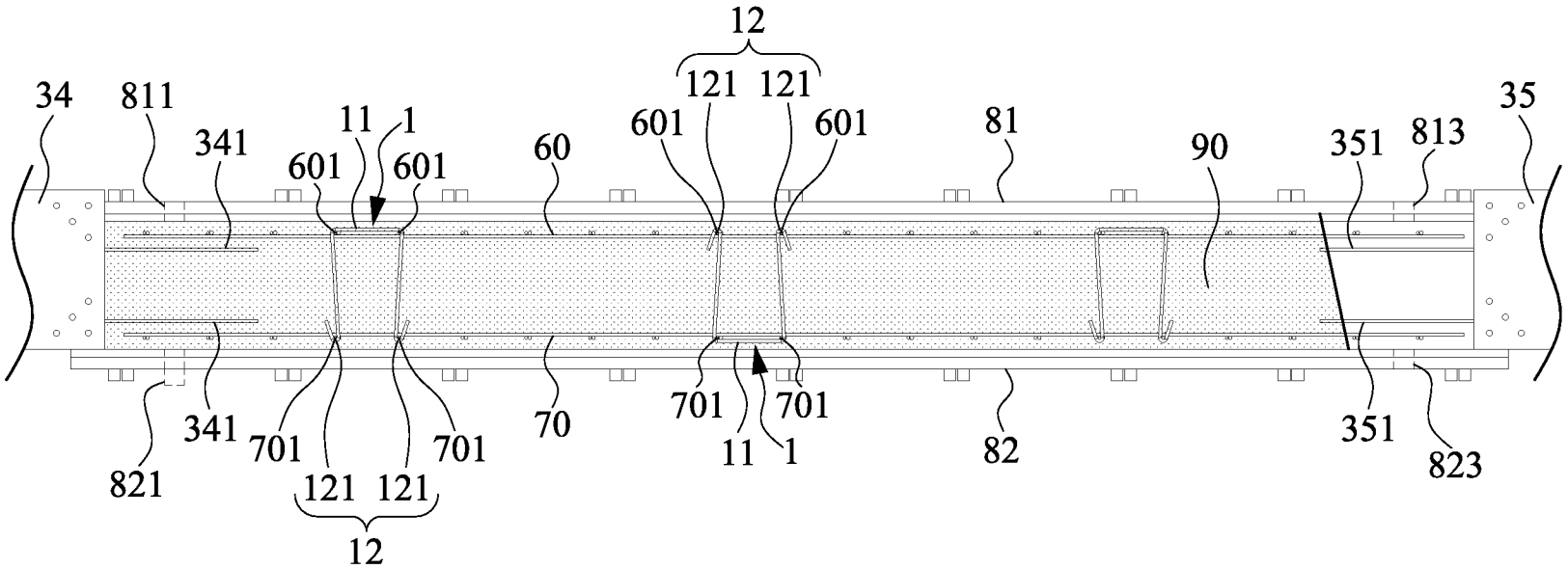
FIG. 3J is an eighth schematic view showing the construction method in accordance with said another embodiment of the present disclosure.
Figure 3K:
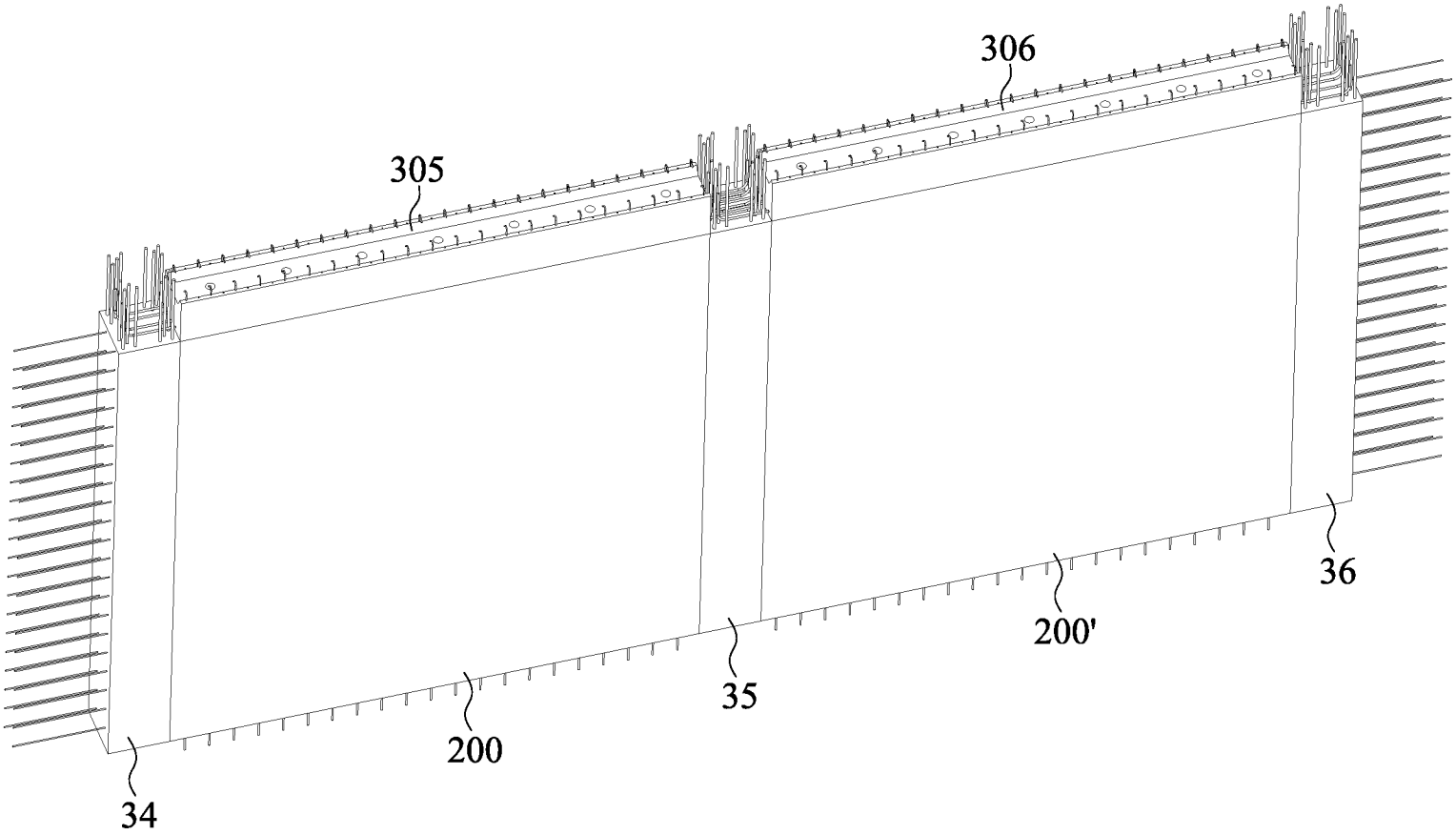
FIG. 3K is a ninth schematic view showing the construction method in accordance with said another embodiment of the present disclosure.

As shown in FIG. 3J, the formwork 81 has outlets 811, 813 adjacent to its upper end and the formworks 82 has an inlet 821 and an outlet 823 adjacent to its upper end. The concrete 90 is poured into the space between the formworks 81 and 82 and between formworks 81' and 82'. Taking the embodiment shown in FIG. 3J as an example, the concrete 90 is poured into between space between the formworks 81 and 82 through the inlet 821 of the formwork 82. When the concrete 90 is poured into the space between the formworks 81 and 82 until reaching a level close to the upper ends of the formworks 81 and 82, the air and a small amount of excess concrete 90 are expelled from the outlets 811, 813, 823. When the small amount of the concrete 90 is expelled from the outlets 811, 813, 823, it means that the air has been removed and the concrete pouring can be stopped. In addition, after the initial setting of the concrete 90, expansive-cement mortar (not shown) is poured into the space between the lower surface of the precast beam 305 and the tops of the steel mesh 60, 70 and the space between the lower surface of the precast beam 306 and the tops of the steel mesh 60', 70', which is around 5 cm in height. FIG. 3K show a shear wall 200 and a shear wall 200' which are formed after the concrete 90 is solidified and formed and the formworks 81, 82 and the formworks 81' and 82' shown in FIG. 3G are removed.

With the tie bar 1 of the present disclosure, the number of the tie bars used in manufacturing the same shear walls 100, 100', 200, 200' can be greatly reduced, reducing costs and labor. The following Table 1 compares the number of bars required for a single shear wall using conventional tie bars and that using the tie bars of the present invention. As shown, the amount can be reduced by 7% to 8% if the tie bars of the present disclosure are used.

TABLE 1

| | Conventional Tie Bar | Tie Bar of the Present Disclosure |
|---|---|---|
| Length (m)/per tie bar | 0.959 | 1.773 |
| Number of tie bars used in the transverse direction | 12 | 6 |
| Number of tie bars used in the vertical direction | 11.4 | 11.4 |
| Total number | 136.5 | 68.25 |
| Total length (m) | 130.9 | 121.0 |
| Total weight (kg) | 130.1 | 120.3 |
| Usage percentage | 100% | 92.4% |

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A construction method comprising:

providing two precast columns spaced apart by a third predetermined distance;

providing a plurality of tension bars in the two precast columns, wherein each of the plurality of tension bars has nut heads at two ends for connecting bars, the nut heads being exposed;

providing and connecting extending bars to the corresponding nut heads of the tension bars;

providing a first steel mesh and a second steel mesh and disposing them between the two precast columns, wherein the first steel mesh and the second steel mesh are spaced apart by a predetermined distance;

connecting the lateral ends of the first steel mesh and the second steel mesh to the extending bars, and providing a plurality of tie bars to fix the first steel mesh and the second steel mesh;

wherein each of the plurality of tie bars comprises:

a first end portion configured to surround and be fixed to two adjacent upstanding vertical bars of the first steel mesh;

a second end portion comprising two free ends, wherein the two free ends are configured to respectively be fixed to two adjacent upstanding vertical bars of the second steel mesh; and two connections connecting the first end portion and the second end portion respectively;

wherein the first end portion, the second end portion and the two connections are integrally formed, and wherein the connections are non-perpendicular to the first steel mesh or to the second steel mesh;

wherein the two free ends of the second end portion have two hooks respectively, and wherein the two hooks are respectively connected to the two connections and configured to respectively hook and to be fixed to the two adjacent upstanding vertical bars of the second steel mesh;

wherein the two hooks are bent outwards; and wherein the two connections respectively extend from outsides of the two adjacent upstanding vertical bars of the first steel mesh to insides of the two adjacent upstanding vertical bars of the second steel mesh.

2. The construction method of claim 1, further comprising:

providing two formworks, wherein the first steel mesh and the second steel mesh are arranged between the two formworks;

providing a plurality of tension tabs, wherein two ends of the tension tabs are connected to the two formworks respectively;

providing and hoisting a precast beam or a semi-precast beam to above the tops of the two precast column;

fixing the two ends of the precast beam or a semi-precast beam to the tops of the two precast column respectively so that a spacing between a bottom surface of the precast beam or the semi-precast beam and the first steel mesh and the second steel mesh is about 5 cm;

pouring concrete into between the two formworks; and pouring expansive-cement mortar into the spacing after the initial setting of the concrete.

* * * * *